US011885205B1

(12) United States Patent
Liu et al.

(10) Patent No.: US 11,885,205 B1
(45) Date of Patent: Jan. 30, 2024

(54) FRACTURING A SUBSURFACE FORMATION BASED ON THE REQUIRED BREAKDOWN PRESSURE ACCOUNTING FOR FILTER CAKE

(71) Applicant: Saudi Arabian Oil Company, Dhahran (SA)

(72) Inventors: Chao Liu, Brookshire, TX (US); Yanhui Han, Houston, TX (US); Dung Phan, Brookshire, TX (US); Katherine Leigh Hull, Houston, TX (US); Younane N. Abousleiman, Norman, OK (US)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/889,024

(22) Filed: Aug. 16, 2022

(51) Int. Cl.

| | |
|---|---|
| ***E21B 43/26*** | (2006.01) |
| ***E21B 7/00*** | (2006.01) |
| ***E21B 43/02*** | (2006.01) |
| ***E21B 47/06*** | (2012.01) |
| ***E21B 49/00*** | (2006.01) |

(52) U.S. Cl.
CPC ..... *E21B 43/02* (2013.01); *E21B 47/06* (2013.01); *E21B 49/00* (2013.01); *E21B 2200/20* (2020.05)

(58) Field of Classification Search
CPC ..... E21B 2200/20; E21B 43/26; E21B 43/02; E21B 49/00; E21B 49/006; E21B 47/06; E21B 47/006; E21B 7/00
See application file for complete search history.

(56) References Cited

U.S. PATENT DOCUMENTS

| | | | | |
|---|---|---|---|---|
| 5,271,465 | A | 12/1993 | Schmidt et al. | |
| 8,714,244 | B2 * | 5/2014 | Conkle | E21B 43/26 166/308.1 |
| 8,973,661 | B2 * | 3/2015 | Zhou | E21B 17/076 166/308.1 |
| 9,677,337 | B2 * | 6/2017 | Bittleston | E21B 7/00 |
| 10,378,344 | B2 * | 8/2019 | Al-Dosary | E21B 49/00 |

(Continued)

OTHER PUBLICATIONS

Abousleiman et al., "Poromechanics response of an inclined borehole subject to in-situ stress and finite length fluid discharge," Journal of Mechanics of Materials and Structures, 5(1), Apr. 2010, 47-66, 21 pages.

(Continued)

*Primary Examiner* — Kenneth L Thompson
(74) *Attorney, Agent, or Firm* — Fish & Richardson P.C.

(57) ABSTRACT

Systems and methods for predicting a breakdown pressure of a formation and fracturing the formation account for filter cake effects. The systems and methods measure a time-dependent permeability and a time-dependent thickness of a filter cake formed by a first drilling mud. The systems and methods determine a time-dependent permeability model and a time-dependent thickness model of the filter cake. The systems and methods select a breakdown pressure model based on (i) the time-dependent thickness of the filter cake, (ii) the time-dependent permeability of the filter cake, and (iii) the permeability of the formation. The systems and methods use the selected breakdown pressure model to predict the breakdown pressure of the formation and fracture the formation using a drilling fluid having a mud weight associated with the predicted breakdown pressure of the formation.

20 Claims, 13 Drawing Sheets

(56) References Cited

U.S. PATENT DOCUMENTS

| | | | | |
|---|---|---|---|---|
| 10,417,561 | B2 | 9/2019 | Mohaghegh | |
| 10,697,273 | B2 * | 6/2020 | Zhang | E21B 47/00 |
| 11,091,989 | B1 * | 8/2021 | De Oliveira | E21B 49/005 |
| 11,091,994 | B2 | 8/2021 | Parkhonyuk et al. | |
| 2010/0181073 | A1 * | 7/2010 | Dupriest | C09K 8/03 166/308.1 |
| 2010/0243242 | A1 * | 9/2010 | Boney | E21B 43/26 166/278 |
| 2023/0184105 | A1 | 6/2023 | Han et al. | |

OTHER PUBLICATIONS

Bradley, "Failure of inclined boreholes," J. Energy Resour. Technol., 1979, 101(4): 232-239, 8 pages.

Chen, "Three-dimensional analytical poromechanical solutions for an arbitrarily inclined borehole subjected to fluid injection," Proceedings of the Royal Society A: Mathematical, Physical and Engineering Sciences, Jan. 2019, 22 pages.

Cui et al., "Poroelastic Solution for an Inclined Borehole," Journal of Applied Mechanics, 64(1):, Mar. 1997, 32-38, 7 pages.

Detournay et al., "Poroelastic response of a borehole in a non-hydrostatic stress field," International Journal of Rock Mechanics and Mining Sciences & Geomechanics Abstracts, 25(3), Jun. 1988, 171-182, 12 pages.

Feng, "Mudcake effects on wellbore stress and fracture initiation pressure and implications for wellbore strengthening," Petroleum Science, Mar. 2018, 15(2), 16 pages.

Haimson et al., "Initiation and extension of hydraulic fractures in rocks," Society of Petroleum Engineers Journal, 7(03):, Sep. 1967, 310-318, 9 pages.

Hiramatsu and Oka, "Stress around a shaft or level excavated in ground with a three-dimensional stress state.," Mem. Frac. Eng. Kyotu Univ., 1962, 24, 56-76, English Abstract, 2 pages.

Hubbert et al., "Mechanics of hydraulic fracturing," Transactions of the AIME, 210(01):, Dec. 1957, 153-168, 16 pages.

Jaffal, "Modeling of filtration and mudcake buildup: an experimental investigation," Journal of Natural Gas Science and Engineering, 2017, 38: 1-11, 11 pages.

Liu and Abousleiman, "Multiporosity/multipermeability inclined-wellbore solution with mud cake effects," SPE J., 2018 23(05): 1723-1747, 19 pages.

Tran et al., "The effects of filter-cake buildup and time-dependent properties on the stability of inclined wellbores," SPE Journal, 16(04):1010-1028, Aug. 2011, 19 pages.

Wu et al., The influence of water-base mud properties and petrophysical parameters on mudcake growth, filtrate invasion, and formation pressure. Petrophysics, 2005, 46(1): 14-32, 19 pages.

U.S. Appl. No. 17/857,826, Albahrani, Failure Criterion Selection Based on A Statistical Analysis of Finite Element Model Results and Rock Imaging Data For Wellbore Modelling, filed Jul. 5, 2022.

* cited by examiner

FRACTURING A SUBSURFACE FORMATION BASED ON THE REQUIRED BREAKDOWN PRESSURE ACCOUNTING FOR FILTER CAKE

TECHNICAL FIELD

The present disclosure relates to systems and methods for determining the breakdown pressure of a formation surrounding a wellbore with a layer of filter cake on a wall of the wellbore (for example, with a layer of filter cake lining the wellbore) and fracturing the formation based on the breakdown pressure.

BACKGROUND

Hydraulic fracturing has been used to stimulate tight sandstone and shale gas reservoirs. Rock breakdown or fracture initiation is typically required for a successful hydraulic fracturing treatment. For hydraulic fracturing treatments, accurately estimating a breakdown pressure of a subsurface (or subterranean) formation may help determine correct selections of casing size, tubing size, and wellhead (for example, to correctly select their respective burst pressure limiting requirements), as well as a pump schedule design. Otherwise, the hydraulic fracturing operation may not properly inject a fracturing liquid to fracture the formation (for example, if the breakdown pressure was underestimated). Conventionally, hydraulic fracturing simulators may not accurately predict the breakdown pressure due to, for example, model simplifications.

SUMMARY

The systems and methods of this disclosure predict breakdown pressures using models that account for a build-up of filter cake along the formation surrounding the wellbore while the wellbore is being drilled. Some systems and methods select among three different breakdown pressure models for predicting the breakdown pressure based on properties of the filter cake (for example, position-and-time-dependent thickness and position-and-time-dependent permeability) and properties of the rock formation (for example, permeability). Some systems and methods perform experiments and/or simulations to determine the position-and-time-dependent thickness and position-and-time-dependent permeability of the filter cake on samples of the formation to make a more informed decision on the appropriate breakdown pressure model. The systems and methods determine the breakdown pressure of the formation using the selected breakdown pressure model, determine an appropriate drilling mud weight to reach the breakdown pressure in the formation, and pump a drilling mud having the drilling mud weight into the formation to fracture the formation and increase well productivity.

In some implementations, the systems and methods automatically select a time-independent elastic model with a permeable wellbore wall without filter cake when the permeability of the rock surrounding the wellbore is high (for example, greater than 1 μD) and no filter cake is present. This model referred to as "model 1" throughout this disclosure.

In some implementations, the systems and method automatically select a time-dependent poroelastic model with an impermeable constant-thickness filter cake when the permeability of the rock surrounding the wellbore is low (for example, less than 1 μD) and no filter cake is present. This is referred to as "model 2" throughout this disclosure. In this case, the thickness variable of the filter cake in model 2 is set to zero. In some implementations, model 2 is selected when the filter cake has a constant thickness with a relatively lower permeability than the formation's permeability (for example, less than 1% of the formation's permeability).

In some implementations, the systems and methods automatically select a time-dependent poroelastic model with time-dependent thickness and permeability filter cake when the filter cake has a thickness that changes over time. This is referred to as "model 3" throughout this disclosure.

One of the many challenges in successful multi-stage hydraulic fracturing operations is the unusually high breakdown pressure of the rock formation encountered. In some examples, this is encountered in sandstone. Filter cake buildup, resulting from drilling operations, can increase the formation breakdown pressure in wellbore drilling, subsequently increasing the fracture gradient, which is beneficial to wellbore stability as the risk of mud loss is reduced. However, in horizontal drilling (for example, extended reach horizontal drilling), filter cake buildup can be detrimental to wellbore stimulation and well productivity. Filter cake may not build up on the wellbore wall when drilling through some shale formations with ultra-low permeability. The low permeability of the rock formation means that fluid leak-off is minimal so filter cake buildup might not occur. However, if the shale formation is naturally fractured, filter cake could partially build up on the wellbore wall because drilling fluid can leak into the formation through natural fractures. Small particles of the filter cake are deposited on portions of the wellbore wall.

The systems and methods of this disclosure predict the breakdown pressure of the formation surrounding the wellbore by accounting for the effects of the deposited particle layer of the filter cake. The systems and methods account for the effects of filter cake in the breakdown pressure prediction by using a different flow and pressure boundary conditions on the wellbore wall compared to conventional breakdown pressure models that do not account for filter cake. For example, in conventional hydraulic fracturing design, the elastic time-independent solution of wellbore stresses is still commonly used to calculate formation breakdown pressure.

An important aspect of the systems and methods of this disclosure relate to knowing which model should be used in a breakdown pressure prediction. This is achieved by determining whether or not filter cake is present, analyzing the permeability of the filter cake and the formation, and analyzing the thickness of the filter cake. In some examples, filter cake is normally not evenly distributed along the horizontal wellbore wall and can vary in both thickness and permeability along the length of the wellbore wall. In some examples each section of the wellbore has its own time-dependent filter cake thickness and permeability. The systems and methods consider the evolution of filter cake (both in space and in time) along the horizontal wellbore wall when selecting the appropriate breakdown pressure model.

Investigating and understanding various parameters and the physics behind breakdown over-pressure (BDOP) and quantifying their effects on BDOP (for example, the transient effects of the filter cake buildup) is of great importance to field operations. BDOP is the breakdown over pressure which is higher than the normal breakdown pressure.

Systems and methods for fracturing a formation include one or more of the following features. The systems and methods drill a wellbore into the formation and measure a time-dependent permeability and a time-dependent thickness of a filter cake formed by a first drilling mud. The systems and methods determine a time-dependent permeability model based on the measured time-dependent permeability of the filter cake and determine a time-dependent thickness model of the filter cake based on the measured time-dependent thickness of the filter cake. The systems and methods measure a permeability of the formation. The systems and methods select a breakdown pressure model based on (i) the time-dependent thickness of the filter cake, (ii) the time-dependent permeability of the filter cake, and (iii) the permeability of the formation. The systems and methods use the selected breakdown pressure model to predict the breakdown pressure of the formation. The systems and methods use the selected breakdown pressure model by using the time-dependent thickness model of the filter cake and the time-dependent permeability model of the filter cake in the breakdown pressure model. The systems and methods determine a critical mud weight based on the predicted breakdown pressure. The systems and methods pump a second drilling mud into the wellbore to fracture the formation. The second drilling mud has a mud weight within 10% of the critical mud weight.

Some systems and methods include one or more of the following features alone or in combination.

Some systems and methods extract one or more samples from the formation perform a filtration experiment on at least one of the one or more samples by pumping the first drilling mud through the at least one sample to measure the time-dependent permeability of the filter cake and the time-dependent thickness of the filter cake.

In some cases, the systems and methods determine the time-dependent permeability model of the filter cake by determining one or more parameters to a first exponential formula based on data from the filtration experiment and determine the time-dependent thickness model of the filter cake by determining one or more parameters to a second exponential formula based on the data from the filtration experiment. In some cases, the first exponential formula is $k_m=a_1\ (1+\exp(-t/tau_1))$ and the second exponential formula is $d_m=a_2\ (1-\exp(-t/tau_2))$, where $a_1$, $tau_1$, $a_2$, and taut are determined based on the data from the filtration experiment.

Some systems and methods perform a core flooding test or a field mini-frac test on at least one of the one or more samples to determine the permeability of the formation. In some cases, the systems and methods perform a tensile test on at least one of the one or more samples to determine a tensile strength of the formation. In some cases, the systems and methods use the tensile strength to predict the breakdown pressure.

Some systems and methods pump the first drilling mud into the wellbore while the wellbore is being drilled to form the filter cake and pump a cleaning fluid into the wellbore after the wellbore is drilled to at least partially remove the filter cake from the wellbore. In some cases, the systems and methods use the filtration experiment to determine one or more effects of the cleaning fluid on the filter cake, update the time-dependent permeability model based on the one or more effects of the cleaning fluid on the filter cake, and update the time-dependent thickness model based on the one or more effects of the cleaning fluid on the filter cake.

Some systems and methods pump the first drilling mud into the wellbore while the wellbore is being drilled to form the filter cake. In some cases, the systems and methods complete the wellbore and extract one or more hydrocarbons from the wellbore after the wellbore has been completed. In some examples, the filter cake is located on a wall of the wellbore and the systems and methods use at least one of a logging device or a sensor to measure the permeability and the thickness of the filter cake within the wellbore.

Some systems and methods select the breakdown pressure automatically by a processor.

Some systems and methods for fracturing a formation include one or more of the following features. The systems and methods drill a wellbore into the formation and measure a permeability and a thickness of a filter cake formed by a first drilling mud. The systems and methods measure a permeability of the formation. The systems and methods select a breakdown pressure model from at least three breakdown pressure models based on (i) the thickness of the filter cake, (ii) the permeability of the filter cake, and (iii) the permeability of the formation. At least one of the at least three breakdown pressure models accounts for a time-dependent permeability of the filter cake and a time-dependent thickness of the filter cake. The systems and methods use the selected breakdown pressure model to predict the breakdown pressure of the formation. The systems and methods determine a critical mud weight based on the predicted breakdown pressure and pump a second drilling mud into the wellbore to fracture the formation. The second drilling mud has a mud weight within 10% of the critical mud weight.

Some systems and methods include one or more of the following features alone or in combination.

Some systems and methods determine whether the thickness of the filter cake is greater than zero and determine whether the permeability of the formation is greater than a predetermined permeability. In some cases, the breakdown pressure model is selected based on whether the thickness of the filter cake is greater than zero and whether the permeability of the formation is greater than the predetermined permeability. In some cases, the predetermined permeability is a permeability between 1 μD and 100 μD.

In some cases, the systems and methods select the breakdown pressure model in response to determining that the thickness of the filter cake is not greater than zero and that the permeability of the formation is greater than the predetermined permeability by selecting a first breakdown pressure model of the at least three breakdown pressure models that neglects filter cake effects and neglects time-dependency.

Some systems and methods determine a permeability ratio of the permeability of the filter cake and the permeability of the formation, determine whether the permeability ratio is below a predetermined ratio, and determine whether the thickness of the filter cake is approximately constant with respect to time. In some cases, in response to determining that the permeability ratio is below the predetermined ratio and that the thickness of the filter cake is approximately constant with respect to time, the systems and methods select a second breakdown pressure model of the at least three pressure breakdown models that includes filter cake effects and neglects time-dependency. In some cases, the predetermined ratio is a ratio between 1% and 10%.

In some cases, the systems and methods select the breakdown pressure model in response to determining that the thickness of the filter cake is not approximately constant with respect to time by selecting a third breakdown pressure model of the at least three breakdown pressure models that includes filter cake effects and includes time-dependency. In some cases, the third breakdown pressure model accounts for changes in the thickness of the filter cake as a function of position and the second model neglects changes in the thickness of the filter cake as a function of position.

Some systems and methods select the breakdown pressure automatically by a processor.

Some systems and methods extract one or more samples from the formation, perform a filtration experiment on at least one of the one or more samples by pumping the first drilling mud through the at least one sample to measure the permeability of the filter cake and the thickness of the filter cake. In some cases, the systems and methods determine a time-dependent thickness model of the filter cake based on data from the filtration experiment and determine a time-dependent permeability model of the filter cake based on data from the filtration experiment. In some cases, the at least one breakdown pressure model that accounts for the time-dependent permeability of the filter cake and the time-dependent thickness of the filter cake uses the time-dependent thickness model and the time-dependent permeability model to predict the breakdown pressure.

In some cases, the time-dependent permeability model is a first exponential formula of $k_m=a_1\ (1+\exp(-t/tau_1))$ and the time-dependent thickness model is a second exponential formula of $d_m=a_2\ (1-\exp(-t/tau_2))$, where $a_1$, $tau_1$, $a_2$, and taut are determined based on the data from the filtration experiment.

The systems and methods described in this specification provide one or more of the following advantages.

The systems and methods capture important physics and mechanisms that are important for breakdown pressure calculation. For example, the systems and methods consider that pore pressure or stresses change with time. The systems and methods account for the transient buildup of filter cake and the porous fluid flow in rock formations in the breakdown pressure prediction. In contrast, conventional commercial products (for example, Drillworks® by Halliburton and Techlog by Schlumberger) use time-independent solutions to calculate formation breakdown pressure.

In some implementations, the systems and methods perform simulations to determine time-dependent thickness and time-dependent permeability of filter cake. Such simulations are helpful when access to the filter cake within the wellbore is not practical or is inaccessible. For example, a user can acquire a sample of the rock and test it in the laboratory using a filtration experiment to determine how filter cake builds up over time on that particular rock and then input the predicted time-dependent filter cake thickness and time-dependent permeability into a computer so the computer can make a more informed selection of the appropriate breakdown pressure model.

In some implementations, the systems and methods account for cleaning operations of the wellbore when determining the time-dependent thickness and time-dependent permeability of filter cake. This can be important in scenarios where the filter cake is cleaned (for example, by chemical injection) before pumping drilling fluid into the wellbore to fracture the formation to stimulate the formation and increase production of the well. For example, a user can perform filtration experiments to determine whether the thickness of filter cake decreases after chemical injection and then input the predicted time-dependent filter cake thickness and time-dependent permeability into a computer so the computer can make a more informed selection of the appropriate breakdown pressure model.

In some implementations, the systems and methods automatically select the breakdown pressure model without user intervention or assistance. This results in a reduced likelihood of user error by selecting an incorrect model. For example, the systems and methods automatically select among three models based on input data either measured from the wellbore or measured from lab experiments. Once the user measures and inputs the relevant material data into a computer system, a computer executes computer code that automatically selects a breakdown pressure model and predicts the breakdown pressure using the selected model without user intervention or assistance.

While generally described as computer-implemented software embodied on tangible media that processes and transforms the respective data, some or all of the aspects may be computer-implemented methods or further included in respective systems or other devices for performing this described functionality. The details of these and other aspects and implementations of the present disclosure are set forth in the accompanying drawings and the description below. Other features, objects, and advantages of the disclosure will be apparent from the description and drawings, and from the claims.

DETAILED DESCRIPTION

The systems and methods of this disclosure predict breakdown pressures using models that account for a build-up of filter cake along the formation surrounding the wellbore while the wellbore is being drilled. Some systems and methods select among three different breakdown pressure models for predicting the breakdown pressure based on properties of the filter cake (for example, position-and-time-dependent thickness and position-and-time-dependent permeability) and properties of the rock formation (for example, permeability). Some systems and methods perform experiments and/or simulations to determine the position-and-time-dependent thickness and position-and-time-dependent permeability of the filter cake on samples of the formation to make a more informed decision on the appropriate breakdown pressure model. The systems and methods determine the breakdown pressure of the formation using the selected breakdown pressure model, determine an appropriate drilling mud weight to reach the breakdown pressure in the formation, and pump a drilling mud having the drilling mud weight into the formation to fracture the formation and increase well productivity.

Figure 1:
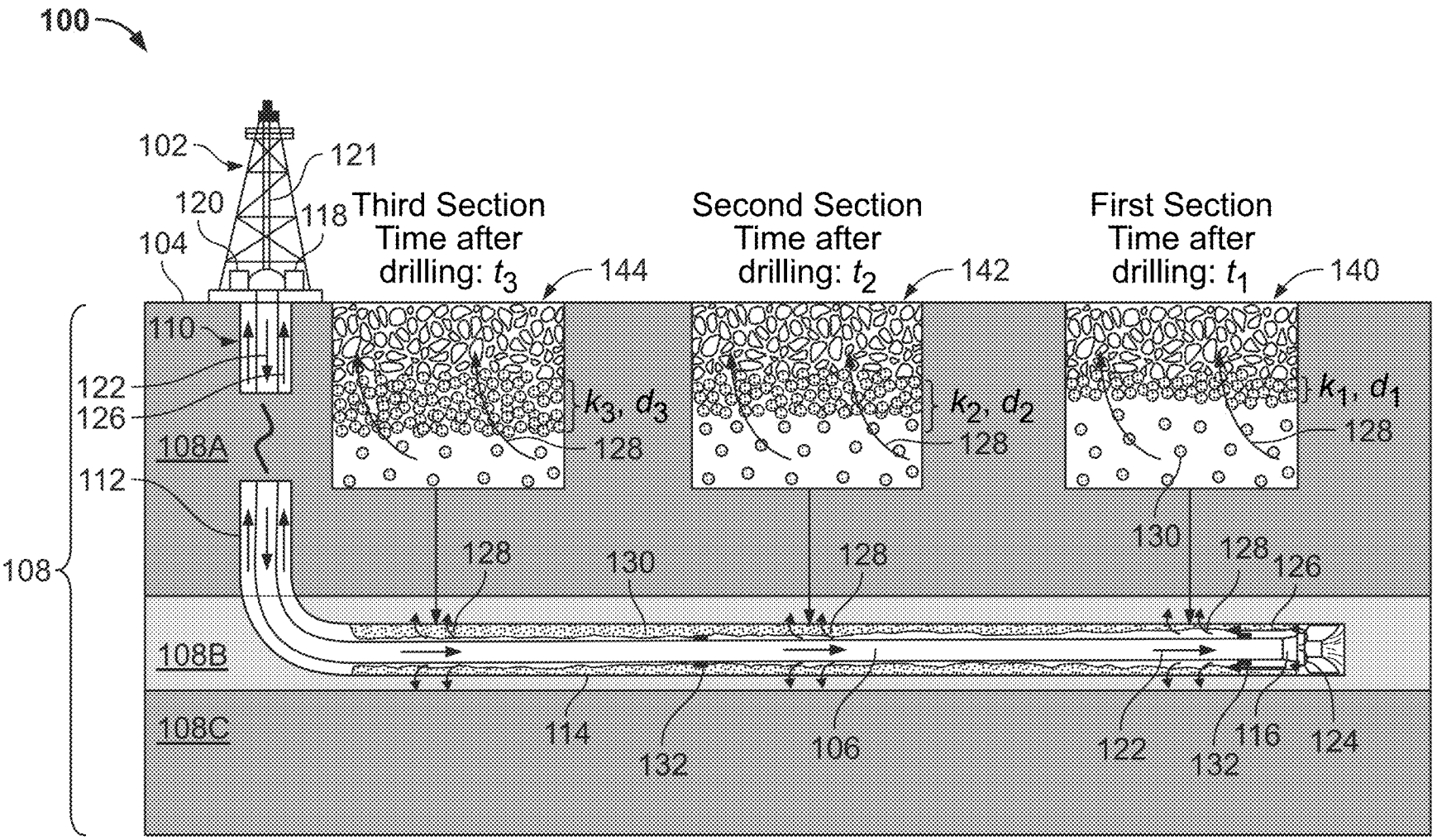
FIG. 1 is an illustration of a wellbore being drilled with a layer of filter cake present.

FIG. 1 is an illustration of a wellbore environment 100. The wellbore environment 100 includes a drill rig 102 located on a ground surface 104. The drill rig 102 includes a drill 121 and a computer 120 that controls the drill 121 to rotate and advance a drill string 106 through one or more formation layers 108 underneath the ground surface 104. The drilling operation forms a wellbore 110 in the formation 108. In the example shown in FIG. 1, the formation layers 108 include a first formation layer 108A that is generally made of dense impermeable rock (for example, cap rock). The formation layers 108 include a second formation layer 108B that is generally made of less-dense permeable rock such as shale, sandstone, limestone, or sand. In some examples, the second formation layer 108B is referred to as "reservoir rock" because hydrocarbons (for example, oil and gas) tend to rise through the permeable reservoir rock. Further upward migration of the hydrocarbons are blocked by the layer of impermeable cap rock 108A so the reservoir rock becomes saturated with the oil and gas and is ideal for hydrocarbon extraction. The systems and methods drill into the second formation layer 108B and extract the hydrocarbons from the reservoir rock.

The drill string 106 has a steerable direction into the formation 108 so that the drill string 106 cuts both a vertical section 112 of the wellbore 110 and a horizontal section 114 of the wellbore 110 into the formation 108. Some wellbores are deviated (or inclined) meaning that the wellbore 110 is not perfectly vertical and instead are drilled at an angle into the formation 108. The drill string 106 includes one or more cutters 116 located on an end of the drill string 106. The cutters 116 engage and cut the formation 108 as the cutters 116 rotate and advance through the formation 108. In some examples, the cutters 116 are diamond cutters.

In the example shown in FIG. 1, the drill string 106 drills vertically through the first formation layer 108A to form the vertical section 112, turns approximately 90 degrees once the second formation layer 108B is reached, and continues drilling horizontally through the second formation layer 108B to form the horizontal section 114. In some examples, the horizontal section 114 is long (for example, between 1,000 ft and 10,000 ft in length). In some examples, a long horizontal section 114 through reservoir rock allows for efficient recovery of oil and gas because there are many access points for the hydrocarbons to flow into the wellbore 110 and be extracted from the formation 108. In most cases, the drill string 106 consists of multiple drill string sections that are mated together (for example, by a bolt or a threaded connection) as the length of the wellbore 110 increases beyond the length of an individual drill string 106.

The drill rig 102 includes a pump 118 (for example, a hydraulic pump) that pumps drilling mud through a central bore of the drill string 106 (for example, in the direction of arrows 122). The drilling mud flows through the central bore of the drill string 106 and exits the central bore of the drill string 106 at or near the cutters 116, reverses direction (for example, as represented by arrows 124), and flows back to the ground surface 104 (for example, in the direction of arrows 126). The fluid path is a closed path so once the drilling mud returns to the ground surface 104, the pump 118 pumps the drilling mud back into the central bore of the drill string 106 and the cycle repeats. In some examples, the drilling mud acts as a drilling fluid that cools the cutters 116 as the cutters 116 cut the formation 108 (for example, by transferring heat of the cutters 116 to the drilling mud) and lubricates the cutters 116 so the cutters 116 do not seize to the formation 108 during the drilling operation.

The drilling mud also stabilizes the wellbore 110 as the wellbore 110 is drilled. In some examples, the drilling mud reduces the likelihood that the wellbore 110 becomes over-pressurized or under-pressurized. For example, an over-pressurized wellbore means that there is a positive pressure gradient displacing the drilling mud into the surrounding formation layer 108B. Not only can such a scenario lead to a substantial loss of drilling mud, it can displace hydrocarbons away from the wellbore 110 which can be counterproductive to extracting the hydrocarbons. In some cases, the pressure gradient is so extreme that the surrounding formation layers 108 can fracture. This scenario is contrasted with an under-pressurized wellbore which is also not a preferable scenario. This is because an under-pressurized wellbore has a pressure gradient directed towards the wellbore 110 which can lead to a collapse of the wellbore wall. The wellbore wall can collapse due to a pressure exerted by the in-situ stresses of the formation. This scenario is bad because it can lead to a complete loss of the wellbore and permanent entrapment of the drill string 106 and cutters 116 within the collapsed wellbore.

In some examples, a small amount of over pressure is preferable (for example, 1-10 MPa greater the pore pressure of the formation 108) as a good balance between these two scenarios. For example, the mud weight is selected to achieve a small amount of over-pressurization of the wellbore 110 as a balance between losing too much drilling mud and avoiding a collapse of the wellbore 110. In some examples, the drilling mud used during the drilling operation has a mud weight between 70 and 110 pounds per cubic foot. As noted above, formation 108B is permeable which means that at least some drilling mud will seep into the formation 108B due to the over-pressure (for example, as shown by arrows 128). Even in cases where the formation 108B is non-permeable, natural fractures in the formation 108B can provide flow paths into and through the formation 108B resulting the same effect.

As the drilling mud seeps into the formation layer 108B, a residue 130 of filter cake builds up on the wall of the wellbore 110. In some examples, the filter cake 130 is referred to as filter mud. As shown in FIG. 1, the filter cake 130 can line a substantial portion of the wellbore 110 and can have a thickness that varies in position (for example, along the length of wellbore 110 and along the circumference of the wellbore 110) and in time (for example, the filter cake 130 can accumulate in a section of the wellbore 110 over time and/or disperse along the wall of the wellbore 110). As illustrated in FIG. 1, filter cake 130 is usually not uniform along the horizontal section 114 of the wellbore 110.

Plot 140 is a microscopic view of the filter cake 130 accumulating along a first section of the wall of the wellbore 110 at time $t_1$ after the wellbore wall of this section has been exposed to the drilling mud. In some implementations, this time is determined by determining the time after the cutters 116 have passed the first section. The filter cake 130 consists of particulates that accumulate along the wall of the wellbore 110 and form a layer of filter cake 130 having a thickness $d_1$. The filter cake 130 has a permeability $k_1$ that varies in position and time along the wellbore wall. In some examples, the permeability varies due to the particulate density changing along the wellbore wall as the particulates flow along the wellbore wall of the wellbore 110.

Plot 142 is a microscopic view of the filter cake 130 accumulating along a second section of the wall of the wellbore 110 at time $t_2$. The filter cake in the second section has a thickness $d_2$ and a permeability $k_2$. In this example, $d_2>d_1$. Plot 144 is a microscopic view of the filter cake 130 accumulating along a third section of the wall of the wellbore 110 at time $t_3$. The filter cake in the third section has a thickness $d_3$ and a permeability $k_3$. In this example, $d_3>d_2$. In some examples, wall sections closer to the cutters 116 have a smaller thickness of filter cake 130 because these sections have been exposed to drilling mud for less time while wall sections further away from the cutters 116 have a larger thickness of filter cake 130.

In some implementations, information about the formation 108 and/or the filter cake 130 is measured during drilling. For example, sensors 132 on the drill string 106 measure the presence and thickness d of the filter cake as the drill string 106 advances through the formation 108. In some implementations, the a plurality of sensors 132 arranged along the drill string 106 scan a length of the wellbore 110 to measure the filter cake 130 along the entire length of the horizontal wellbore section 114. In some examples, the sensors 132 measure mechanical properties of the formation 108 such as the Elastic modulus of the formation, the Poisson's ratio of the formation, the viscosity of the formation, the tensile strength of the formation, the permeability of the formation, Biot's coefficient of the formation, Biot's modulus of the formation, the porosity of the formation, and whether the formation has fractures present. In some examples, the sensors 132 determine the rock type as being either shale, sandstone, limestone, cap rock, or another rock type. In some examples, the sensors 132 measure mechanical properties of the filter cake 130 such as the Elastic modulus of the filter cake 130, the permeability of the filter cake 130, and the thickness of the filter cake 130.

In some implementations, information about the formation 108 and/or the filter cake 130 is measured after drilling. For example, a logging device (not shown) is lowered into the wellbore 110 to measure logging data of the formation 108 and the filter cake 130. In some implementations, the logging device measures the same mechanical properties of the formation 108 and the filter cake 130 that the sensors 132 can measure. In some implementations, logging data is acquired at one or more offset wells that have been drilled through the same formation. The logging data is processed to determine the mechanical properties described above.

In some implementations, information about the formation 108 and/or the filter cake 130 is measured in the laboratory by testing a sample of the formation 108 using a filtration experiment. In some implementations, the filtration experiments determine how a filter cake builds up on a sample of the formation when exposed to drilling fluid that has been pumped into the wellbore 110. The grown filter cake representing the same or similar filter cake that is expected to be present on the wellbore wall of the wellbore 110. In some implementations, the filtration experiments determine the effects of cleaning operations on the positon-and-time-dependent thickness and the positon-and-time-dependent permeability using the laboratory-formed filter cake. Further details about the filtration experiments are described with reference to FIGS. 3-5.

Figure 2:
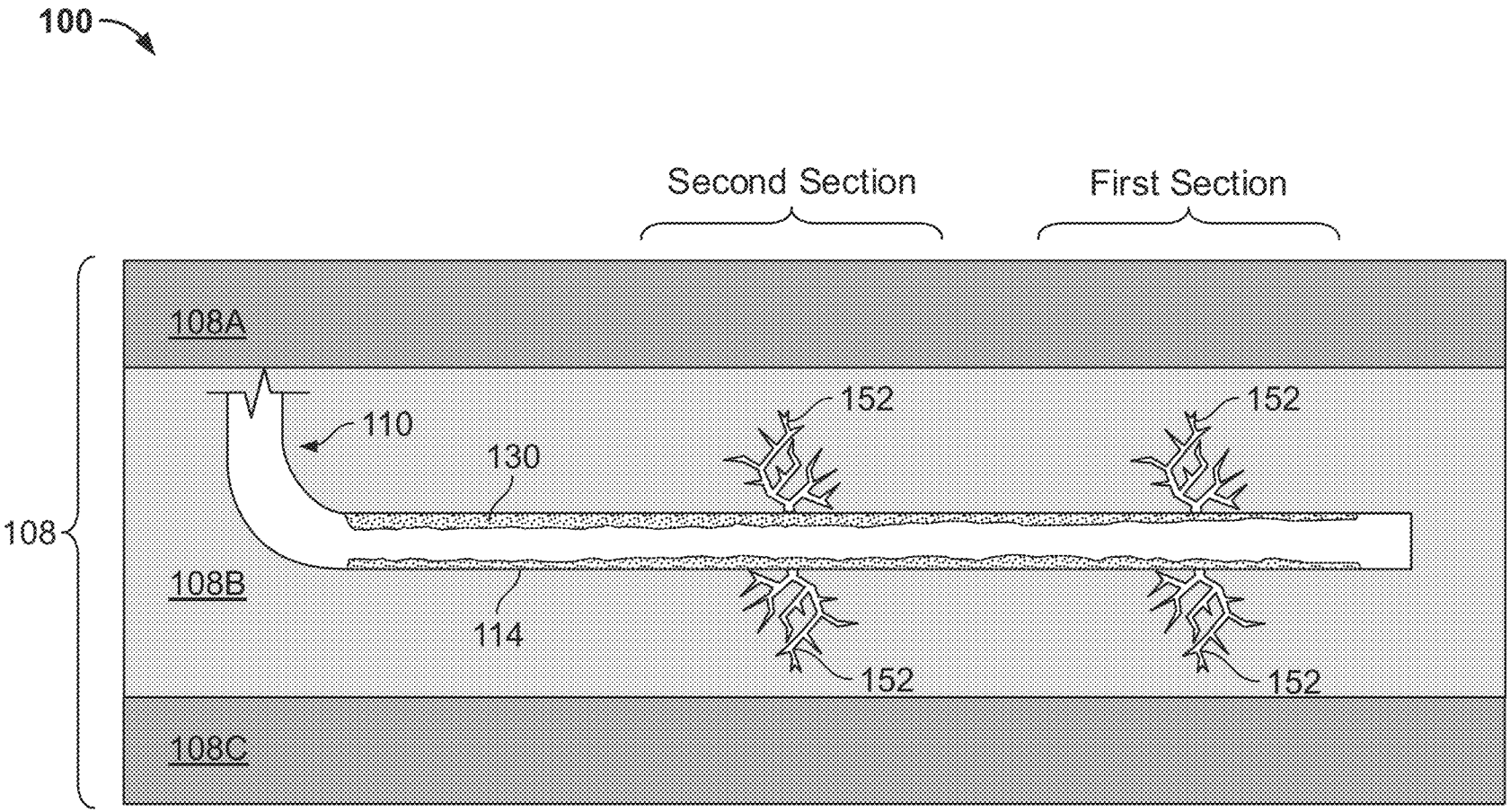
FIG. 2 is an illustration of a formation being fractured with filter cake present.

FIG. 2 is an illustration of the wellbore environment 100 where the formation 108B is fractured 152 while the filter cake 130 is present. The formation 10B is fractured 152 after the wellbore 110 has been drilled and the drill string 106 and cutters 116 have been removed. In the example shown in FIG. 2, the fractures 152 are caused by excessive effective-tensile-stress concentrations that form in the formation due to high drilling-mud density (for example, the drilling mud density required for fractures to occur as predicted by the systems and methods of this disclosure). The fractures 152 are also referred to as perforations in the formation 108B. The fractures 152 allow the hydrocarbons to flow from a reservoir to the wellbore 110.

In some examples fracturing occurs in addition to the natural occurring fractures that are present in the formation 108 (for example, naturally occurring fractures are illustrated in plots 140, 142, and 144 of FIG. 1). In addition to using drilling mud to fracture the formation 108, shape charge explosives or other techniques could be used.

In some examples, the drilling mud that causes fractures 152 to form is the same drilling mud that forms the filter cake 130. In some examples, the drilling mud that causes fractures 152 to form is a different drilling mud than the drilling mud that forms the filter cake 130.

The pressure that is required to fracture the formation 108B is referred to as the "breakdown pressure." Using a pressure that is too large can be catastrophic for the integrity of the wellbore 110 and/or the formation 108. Using a pressure that is too low can result in fractures 152 failing to form which decreases the productivity of the production well. Additionally, the presence of the filter cake 130 affects the required breakdown pressure. For example, ignoring the effects of filter cake 130 when filter cake is present can mean that the fractures 152 do not form at all (or are significantly smaller than anticipated). Additionally, the pump 118 is sized to provide sufficient pressure to the drilling mud to cause the fractures 152. If the breakdown pressure is under predicted then the pump 118 might be undersized.

The systems and methods account for position-and-time-dependent permittivity k of the filter cake 130 and the position-and-time dependent thickness d of the filter cake 130 to determine the required breakdown pressure of the formation 108. In some examples, this means that the required breakdown pressure varies from section to section in the wellbore 110 (for example, between the first and second sections shown in FIGS. 1 and 2). An illustration of how the breakdown pressure varies within the wellbore is descried with reference to FIG. 18. The systems and methods of this disclosure determine the breakdown pressure of the formation 108 by automatically selecting a pressure breakdown model based on properties and/or conditions of the filter cake 130 and the formation 108. In some implementations, the systems and methods automatically select among three models.

In some implementations, the position-and-time-dependent filter cake 130 permittivity k and thickness d are measured using a filtration experiment. Filtration experiments are performed on samples of the formation (for example, core samples or drill cuttings) to determine how filter cake builds up with time on the formation. For example, a sample (for example, a core sample or drill cuttings) is extracted from the formation 108 and tested using a filtration experiment to measure (i) how the thickness of the filter cake 130 changes as a function of position and time and (ii) how the permittivity of the filter cake 130 changes with position and time. Different chemical compositions of the drilling mud and filter cake 130 can also be explored using a filtration experiment. Filtration experiments are described further with reference to FIG. 3.

Figure 3:
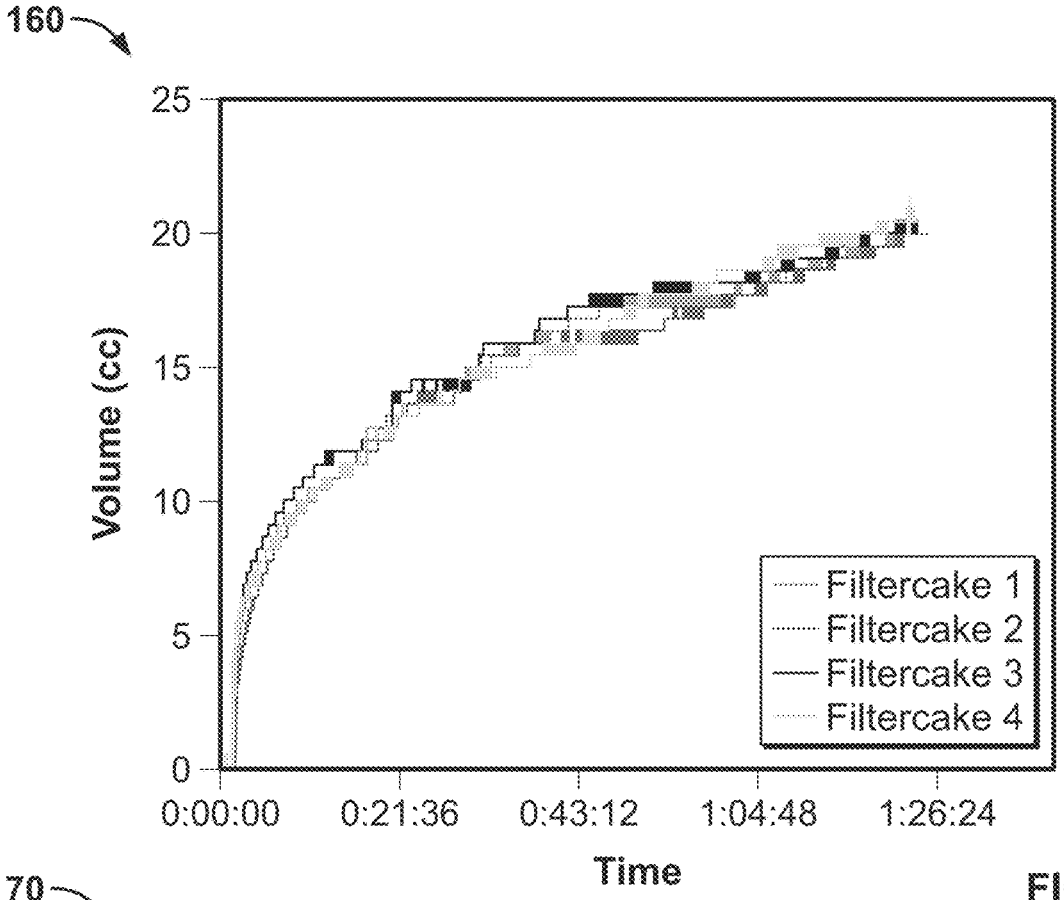
FIG. 3 is a plot of volume measurements from filtration experiments that are used to determine filter cake thickness and permeability.

FIG. 3 is a plot 160 of volume measurements from filtration experiments that are used to determine filter cake thickness and permeability. In an experiment, water-based drilling mud was prepared according to the following procedure. A mixer was used to combine 8 g KCl, 0.2 g NaOH, 0.2 g Na2CO3, and 6 g hydroxyethyl cellulose. After mixing for 5 minutes, 1 g xanthan gum was added and mixed another minute. 0.5 g NaS2O3, 0.5 biocide, 20 g CaCO3 (5 μm), and 20 g CaCO3 (20 μm) were added and mixed for another minute. Defoamer was added dropwise as needed and mixed 30 more seconds. 35 mL of the prepared drilling mud was placed in each of four cells of a filter press (for example, an OFITE filter press). A ceramic filter disc was added to each, and the cells were sealed and placed in the filter press. The cells were heated to 250° F. at 700 psi, and the bottom valve was opened to allow fluid to pass through the filters producing solid cakes composed of the slurry components. The filtrate was collected on a balance and the results of the filtrate volume collected during filter cake deposition are shown in FIG. 3.

In some implementations, the computer performs a curve fit to data of the filtration experiments described with reference to FIG. 3 to determine the following relations:

$$k_m=200(1+e^{-0.00006t}) \tag{1}$$

$$d_m=3(1-e^{-0.0001t}) \tag{2}$$

Figure 4:
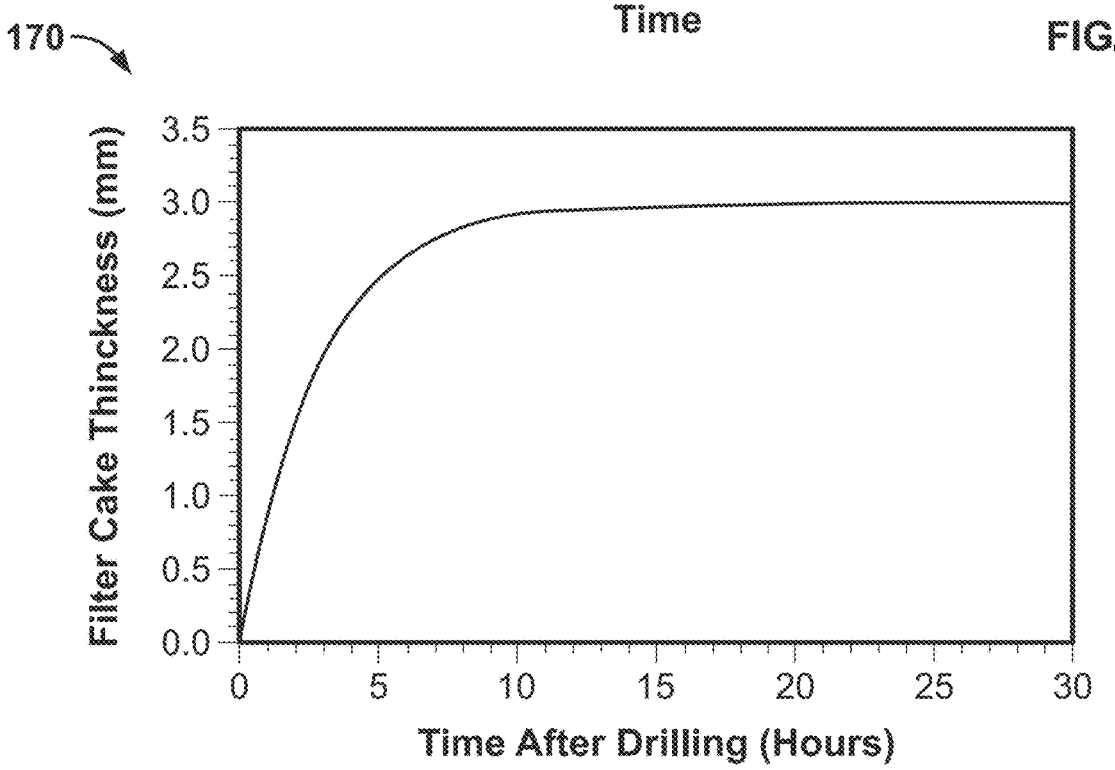
FIG. 4 is a plot of the evolution of a filter cake thickness during the filtration experiments.

FIG. 4 is a plot 170 of the evolution of a filter cake thickness during the filtration experiments described with reference to FIG. 3 and represents the relation of equation (2). The filter cake thickness increases from zero to a steady thickness of 3.0 mm over a period of about 10-15 hours. This time-dependent buildup of the filter cake would alter the stresses and pore pressure distributions around the wellbore wall if this filter cake were located on the inside wall of the wellbore. This means that accounting for the time-dependent thickness of filter cake in breakdown pressure predictions is important this filter cake is expected to be present within the wellbore.

Figure 5:
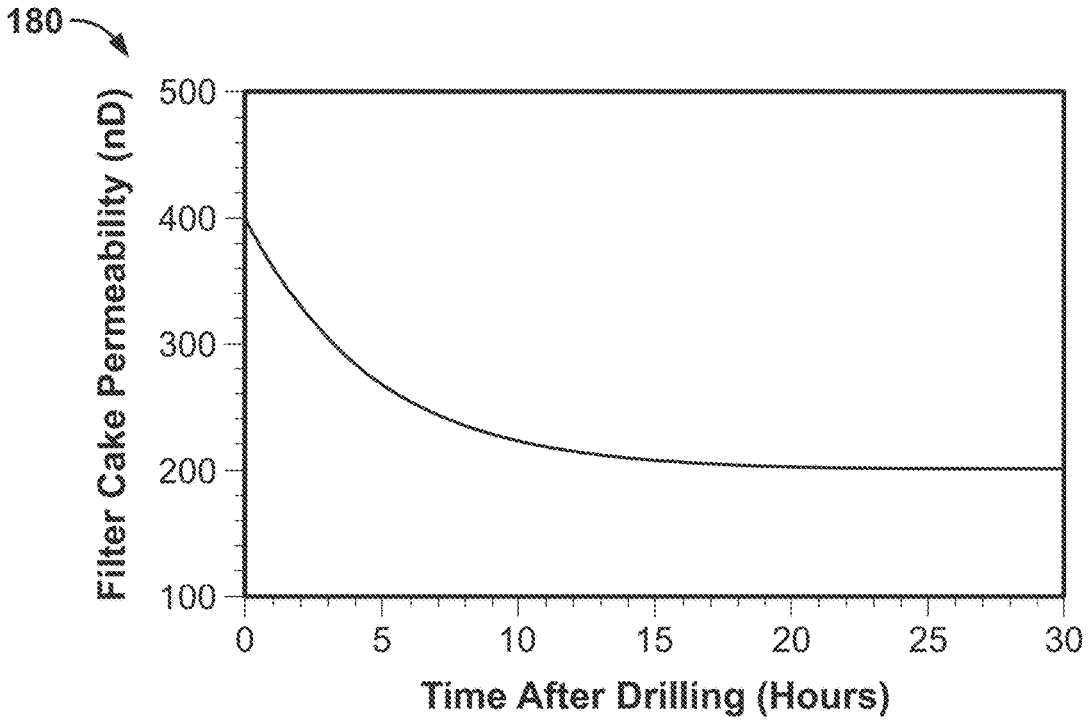
FIG. 5 is a plot of the evolution of a filter cake permeability during filtration experiments.

FIG. 5 is a plot 180 of the evolution of a filter cake permeability during the filtration experiments described with reference to FIG. 3 and represents the relation of equation (1). The filter cake permeability decreases from 400 nD to 200 nD over a period of about 10-15 hours. This time-dependent change of the filter cake permeability would also alter the stresses and pore pressure distributions around the wellbore wall if this filter cake were located on the inside wall of the wellbore. This means that accounting for the time-dependent permeability of filter cake in breakdown pressure predictions is important if this filter cake is expected to be present within the wellbore. It also means that the breakdown pressure varies with time. As shown in FIGS. 4 and 5, the thickness of the filter cake increases with time while the permeability of the filter cake decreases with time.

The results shown in FIGS. 4 and 5 are (i) used to inform the selection of the appropriate breakdown pressure model and (ii) used in the breakdown pressure prediction so that the breakdown pressure accounts for the transient nature of the permeability and thickness of the filter cake. For example, a user provides the simulated model of the thickness and permeability of the filter cake according to equations (1-2) to the computer so the computer could select the appropriate breakdown pressure model and the breakdown pressure based on the selected model. The breakdown pressure models are described with reference to FIGS. 6-11.

In some implementations, the sensors 132 and/or the logging device measures the position-and-time-dependent filter cake 130 permittivity k and thickness d. For example, the sensors 132 and/or the logging device measures data that represents the thickness of the filter cake as a function of (i) axial position along the wellbore 110, (ii) circumferential position around the wellbore 110, and (iii) time. In some examples, the sensors 132 and/or the logging device measures data that represents the permeability of the filter cake as a function of (i) axial position along the wellbore 110, (ii) circumferential position around the wellbore 110, and (iii) time. In such cases, the computer performs a curve fit of the measured position-and-time-dependent filter cake 130 permittivity k and thickness d to determine the models of equations (1-2). In turn, equations (1-2) are used to select the appropriate breakdown pressure model and predict the breakdown pressure based on the selected model.

Governing Equations for Wellbore Stress and Pore Pressure.

Figure 6:
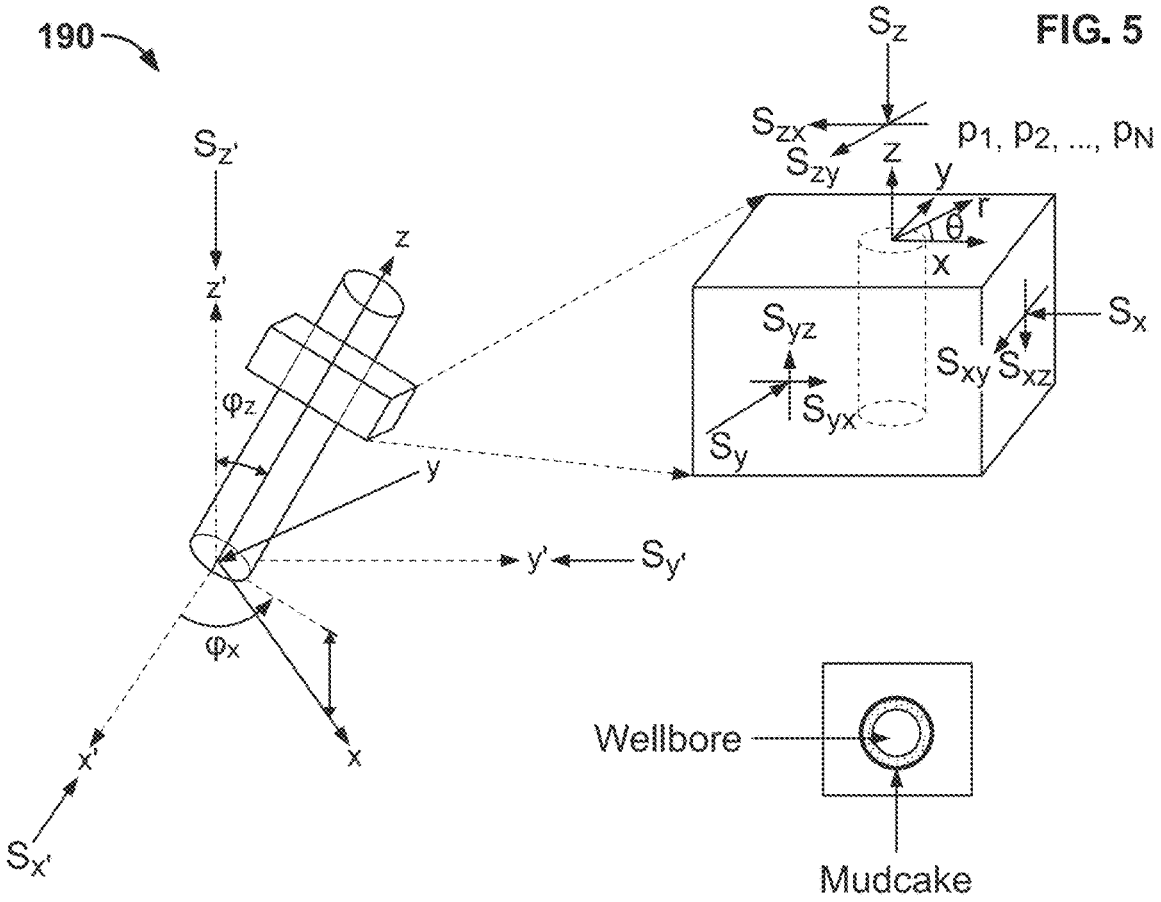
FIG. 6 is a schematic of the stresses and orientations of an inclined wellbore poromechanics problem.

FIG. 6 is a schematic 190 of the stresses and orientations of the inclined wellbore problem. Each of the three models used in this disclosure assume that the constitutive equations take the form:

$$\sigma_{ij} = \frac{E}{1+\nu}\left(\varepsilon_{ij} + \frac{\nu}{1-2\nu}\varepsilon_{kk}\delta_{ij}\right) + \alpha p\delta_{ij} \tag{3}$$

$$\zeta = -\alpha\varepsilon_{kk} + \frac{p}{M} \tag{4}$$

where $\sigma_{ij}$ and $\varepsilon_{ij}$ are the stress and strain tensors, respectively; E and v are the overall Young's modulus and Poisson's ratio, respectively; $\alpha$ is the Biot's coefficient; p is the pore pressure; $\delta_{ij}$ is the Kronecker delta function; is the fluid content variation; and M is the Biot's modulus.

The fluid mass balance equation is as follows:

$$\frac{\partial\zeta}{\partial t} = -\nabla q \tag{5}$$

where q is the fluid flux.

The equilibrium equations take the following form:

$$\frac{\partial\sigma_{ij}}{\partial x_j} = 0 \tag{6}$$

The fluid flow in the rock is assumed to obey Darcy's law:

$$q = -\frac{k}{\mu}\nabla p \tag{7}$$

Boundary and Initial Conditions.

Figure 7:
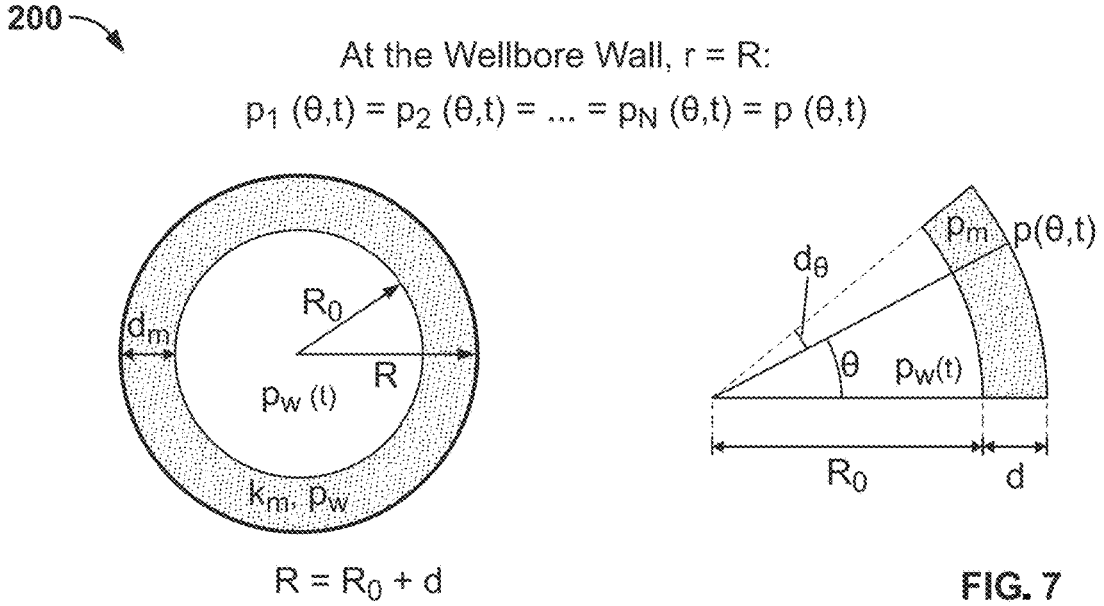
FIG. 7 is a schematic of the boundary and initial conditions of an inclined wellbore poromechanics problem.

FIG. 7 is a schematic 200 of the boundary and initial conditions of the inclined wellbore problem. The formation is under the loading of in-situ pore pressure and stresses. The far-field pore pressure and stresses generally do not change after the wellbore is drilled and are assumed to be constant for all time. The model accounts for the fact that pore pressure does not equal wellbore pressure at the wellbore wall because of the additional pressure drop across the filter cake. Thicker and less-permeable filter cake generally results in lower pore pressure because of the larger pore pressure drop across the filter cake. This causes larger effective radial stresses for cases with thicker and less-permeable filter cake compared to cases with thinner and more-permeable filter cake.

Considering a layer of filter cake on the wellbore wall of the wellbore with permeability $k_m$ and thickness $d_m$ (where the subscript "m" represents the filter cake (also referred to as mud cake)), the boundary conditions at the wellbore wall are listed below:

For a permeable wellbore wall, at r=R, the following boundary and initial conditions are applied:

$$\mu Rq \ln\frac{R}{R-d_m} + k_m p = k_m p_w \tag{8}$$

$$\sigma_{rr} = p_w \tag{9}$$

$$\sigma_{r\theta} = 0 \tag{10}$$

where the subscript "w" represents the wall of the wellbore and $p_w$ represents the pressure of a drilling mud pumped into the wellbore after drilling. In some examples, this drilling mud is the same as the drilling mud described with reference to FIG. 1. In some examples, this drilling mud is different from the drilling mud described with reference to FIG. 1. Filter cake generally builds up in cases of overbalance drilling where the pressure of the drilling mud exceeds the pore pressure in the formation (for example, when $p_w>p$). In some examples, the pore pressure is 10 MPa and the drilling mud pressure is 12 MPa.

Considering that the filter cake is soft and flexible compared with the rock formation, the models assume that the filter cake does not exert any shear tractions on the wellbore wall and that the filter cake is capable of fully transmitting the radial stress from the drilling mud pressure to the wellbore wall. For an impermeable wellbore wall, at r=R, the following boundary and initial conditions are applied:

$$q=0 \tag{11}$$

$$\sigma_{rr}=p_w \tag{12}$$

$$\sigma_{r\theta}=0 \tag{13}$$

Model 1: Time-Independent Elastic Model with a Permeable Wellbore Wall without Filter Cake.

Model 1 is used to calculate the breakdown pressure for rock formations with high permeability (for example, k>1 μD or k>10 μD). Sandstones generally have a high permeability. Model 1 is used when no (or a negligible amount of) filter cake is present on the wellbore wall such that $d_m=0$ in the boundary condition of equation (8). Model 1 is also used when fluid flow through the formation is negligible such that time dependence of the fluid mass balance equation (3) is neglected.

The constitutive and equilibrium equations (2-7) are solved using the boundary and initial conditions equations (8-13) and kinematics of the inclined wellbore shown in FIGS. 6 and 7 along with the assumption that $d_m=0$ (no filter cake) to yield the following elastic solution of wellbore stresses:

$$\sigma_{rr} = \frac{S_x+S_y}{2}\left(1-\frac{R^2}{r^2}\right) + \frac{S_x-S_y}{2}\left(1+\frac{3R^4}{r^4}-\frac{4R^2}{r^2}\right)\cos 2\theta + S_{xy}\left(1+\frac{3R^4}{r^4}-\frac{4R^2}{r^2}\right)\sin 2\theta + p_w\frac{R^2}{r^2} \tag{14}$$

$$\sigma_{\theta\theta} = \frac{S_x+S_y}{2}\left(1+\frac{R^2}{r^2}\right) - \frac{S_x-S_y}{2}\left(1+\frac{3R^4}{r^4}\right)\cos 2\theta - S_{xy}\left(1+\frac{3R^4}{r^4}\right)\sin 2\theta - p_w\frac{R^2}{r^2} \tag{15}$$

$$\sigma_{zz} = S_z - v\left[2(S_x-S_y)\frac{R^2}{r^2}\cos 2\theta + 4S_{xy}\sin 2\theta\right] \tag{16}$$

$$\sigma_{r\theta} = \frac{S_y-S_x}{2}\left(1-\frac{3R^4}{r^4}+\frac{2R^2}{r^2}\right)\sin 2\theta + S_{xy}\left(1-\frac{3R^4}{r^4}+\frac{2R^2}{r^2}\right)\cos 2\theta \tag{17}$$

$$\sigma_{\theta z} = (-S_{xz}\sin\theta + S_{yz}\cos\theta)\left(1+\frac{R^2}{r^2}\right) \tag{18}$$

$$\sigma_{rz} = (S_{xz}\cos\theta + S_{yz}\sin\theta)\left(1-\frac{R^2}{r^2}\right) \tag{19}$$

where $\sigma_{rr}$, $\sigma_{\theta\theta}$, $\sigma_{zz}$, $\sigma_{r\theta}$, $\sigma_{\theta z}$, and $\theta_{rz}$ are stresses expressed in the wellbore coordinates; $S_x$, $S_y$, $S_z$, $S_{xy}$, $S_{xz}$, and $S_{yz}$ are far-field stresses expressed in the global xyz-coordinates; R is the wellbore radius; r is the radial distance from the center of the wellbore into the formation, v is the Poisson's ratio of the formation, θ is the deviation angle of a section of the wellbore. For example, the horizontal wellbore section 114 of the wellbore 110 has a deviation angle of 90 degrees and the vertical wellbore section 112 of the wellbore 110 has a deviation angle of 0 degrees. The models of this disclosure account for the angles of inclination (or deviation).

In order to use equations (14-19), the Young's modulus of the formation and the Poisson's ratio of the formation (v) are determined and/or estimated. In some examples, these material properties are determined from well logging data or laboratory experiments. For example, an engineer acquires mechanical testing data from a laboratory experiment and determines the Young's modulus and the Poisson's ratio of the formation by processing the mechanical testing data on a computer. The far-field in-situ stresses ($S_x$, $S_y$, $S_z$, $S_{xy}$, $S_{xz}$, and $S_{yz}$) and pore pressure are also determined and/or predicted. In some examples, the far-field in-situ stresses and pore pressure are determined from well logging data or a pressure transient analysis. For example, an engineer acquires logging data from the well and determines the in-situ stresses and pore pressure by processing the logging data on a computer.

In model 1, the wellbore wall is assumed to be permeable and the rock formation pore pressure is equal to the wellbore pressure. Therefore, in this first model, the effective stresses are calculated based on the following equations:

$$\sigma'_{rr}=\sigma_{rr}-p_w \tag{20}$$

$$\sigma'_{zz}=\sigma_{zz}-p_w \tag{21}$$

$$\sigma'_{\theta\theta}=\sigma_{\theta\theta}-p_w \tag{22}$$

where $\sigma'_{rr}$, $\sigma'_{zz}$, and $\sigma'_{\theta\theta}$ are the effective radial, axial, and tangential stresses. Equations (18-20) are evaluated to determine the effective stresses for the normal stresses ($\sigma'_{rr}$, $\sigma'_{zz}$, and $\sigma'_{\theta\theta}$) since there are no effective shear stresses for are, $\sigma_{r\theta}$, $\sigma_{rz}$, and $\sigma_{\theta z}$.

$S_{min}$ and $S_{max}$ are determined based on the far-field stresses ($S_x$, $S_y$, $S_z$, $S_{xy}$, $S_{xz}$, and $S_{yz}$) and represent the minimal principal stress and the maximum principal stress in the cross-sectional plane of the wellbore.

Figure 8:
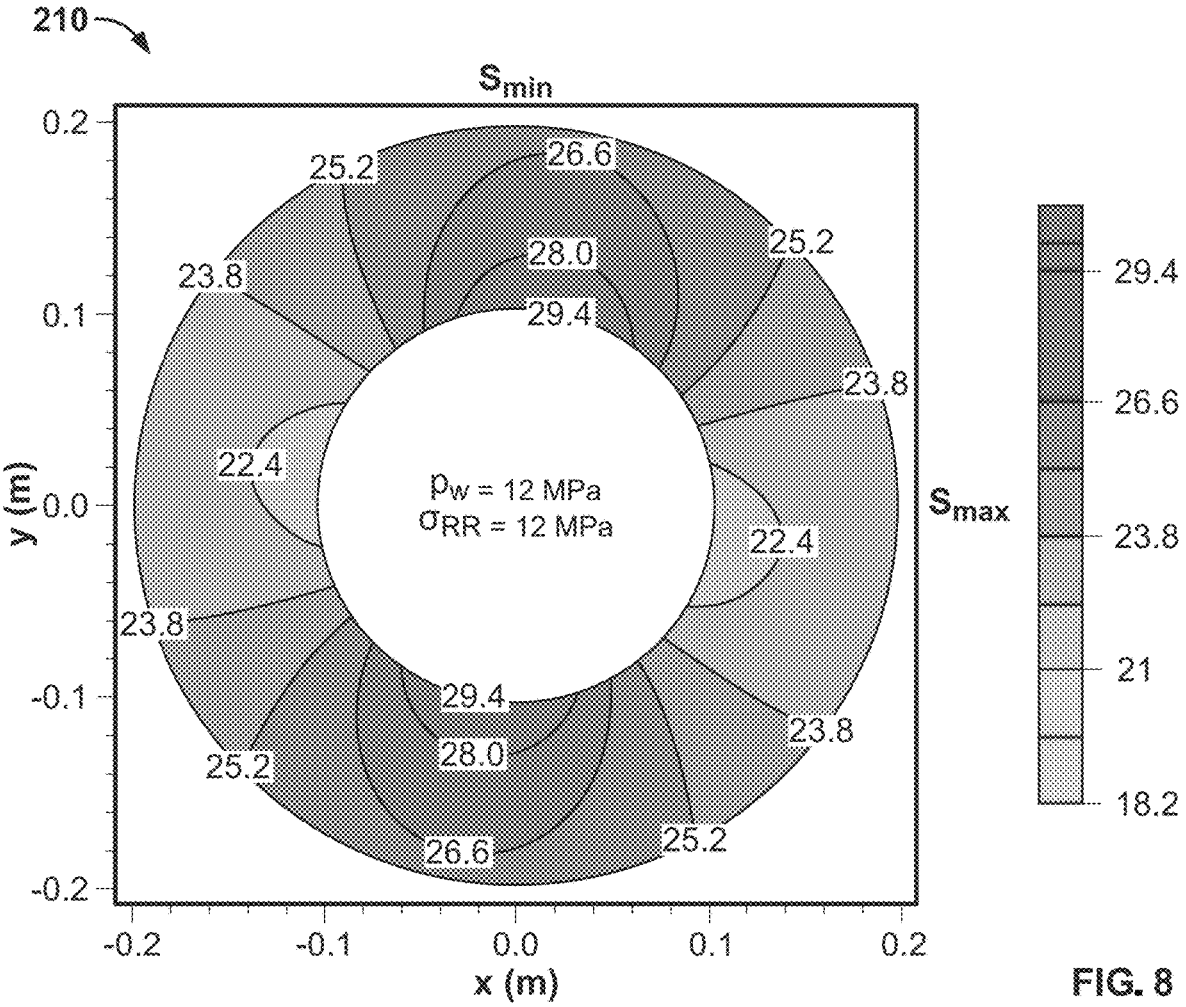
FIG. 8 is a plot of an example stress state in a formation surrounding a wellbore with no filter cake.

FIG. 8 is a plot 210 of an example stress state in a formation surrounding a wellbore with no filter cake. The particular values are for illustration purposes and the values will depend on many of the material parameters and boundary conditions described with reference to equations (3-22). The stress contour varies circumferentially around the wellbore and also varies radially into the formation. The computer determines plot 270 by solving equations (3-22). Minimal principal stress and maximum principal stress directions are also illustrated which depend on the particular values of the tensor components of the far-field stresses.

Figure 9:
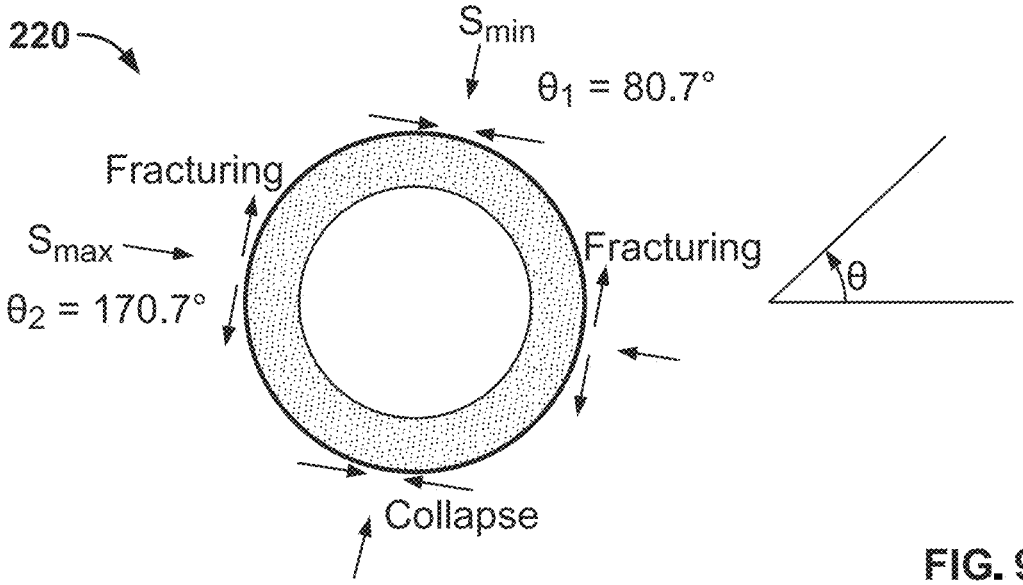
FIG. 9 is a plot of example regions of the formation where collapse and fracture are predicted to occur.

FIG. 9 is a plot 220 of example regions of the formation where collapse and fracture are predicted to occur. Fracturing is most likely to occur in the direction of $S_{max}$ and collapse is most likely to occur in the direction of $S_{min}$.

In order predict the pressure when the formation will fracture, the tensile strength T of the formation is determined and/or estimated. In some examples, the tensile strength is determined from well logging data or from Brazil tensile experiments. For example, an engineer performs a Brazil tensile experiment on a core sample of the formation 108B to determine the tensile strength of the formation 108B.

The model determines the breakdown pressure by first defining a fracturing potential V as follows:

$$V = \max_{0 \le \theta \le 2\pi} [-\sigma_{min} - T] \tag{23}$$

where θ represents the angle around the cross-sectional plane of the wellbore, $\sigma_{min}$ represents the effective minimum principle stress which is determined based on the effective stresses ($\sigma'_{rr}$, $\sigma'_{zz}$, and $\sigma'_{\theta\theta}$), and T represents the tensile strength of the formation.

Figure 10:
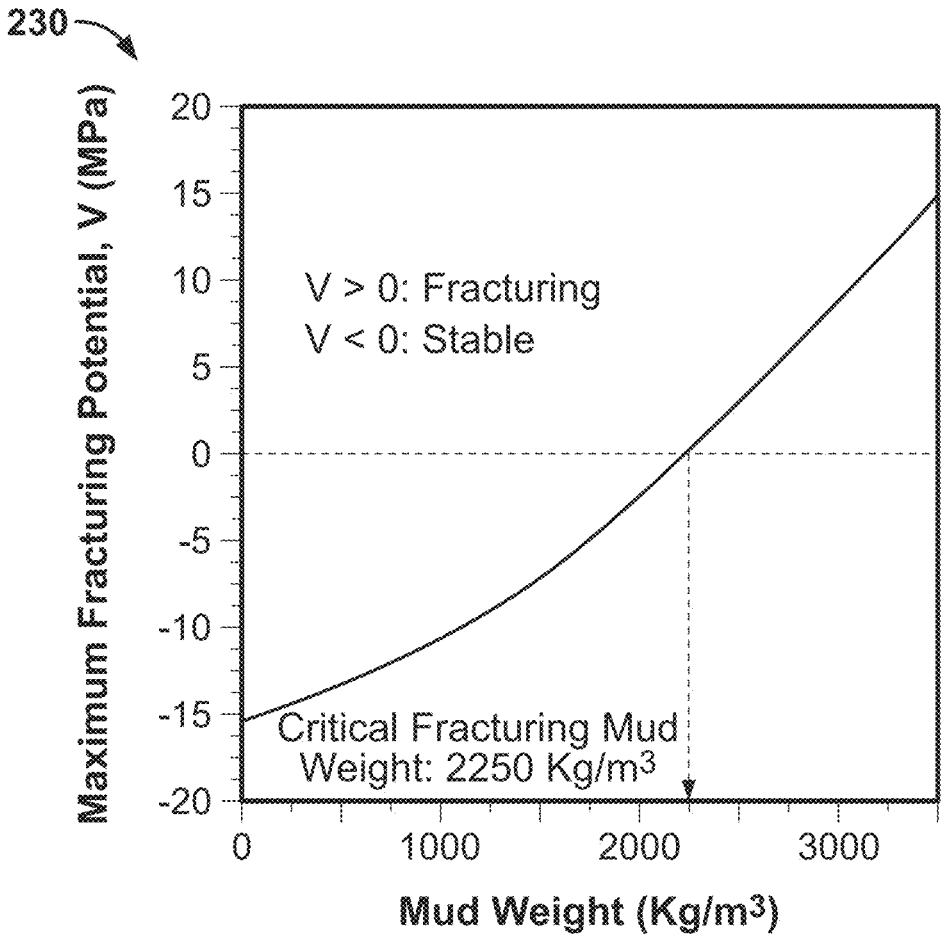
FIG. 10 is a plot relating a fracturing potential V to mud weight to determine a critical fracturing mud weight.

FIG. 10 is a plot 230 relating the fracturing potential V (MPa) to mud weight (kg/m$^3$). In the example shown in FIG. 10, the critical fracturing mud weight is 2,250 kg/m$^3$. This means that pumping a drilling mud having a mud weight of 2,250 kg/m$^3$ (or greater) will fracture the wellbore. Drilling mud having a mud weight less than 2,250 kg/m$^3$ is stable and will not fracture the wellbore. This is an example based on example material properties of the formation, in-situ stress, pore pressure, and geometric properties of the wellbore. Other parameters will result in different values in FIG. 10. Generally, it is difficult to form a drilling mud having exactly the necessary mud weight. In some examples, a mud weight within about 10% of the necessary mud weight is acceptable.

Figure 11:
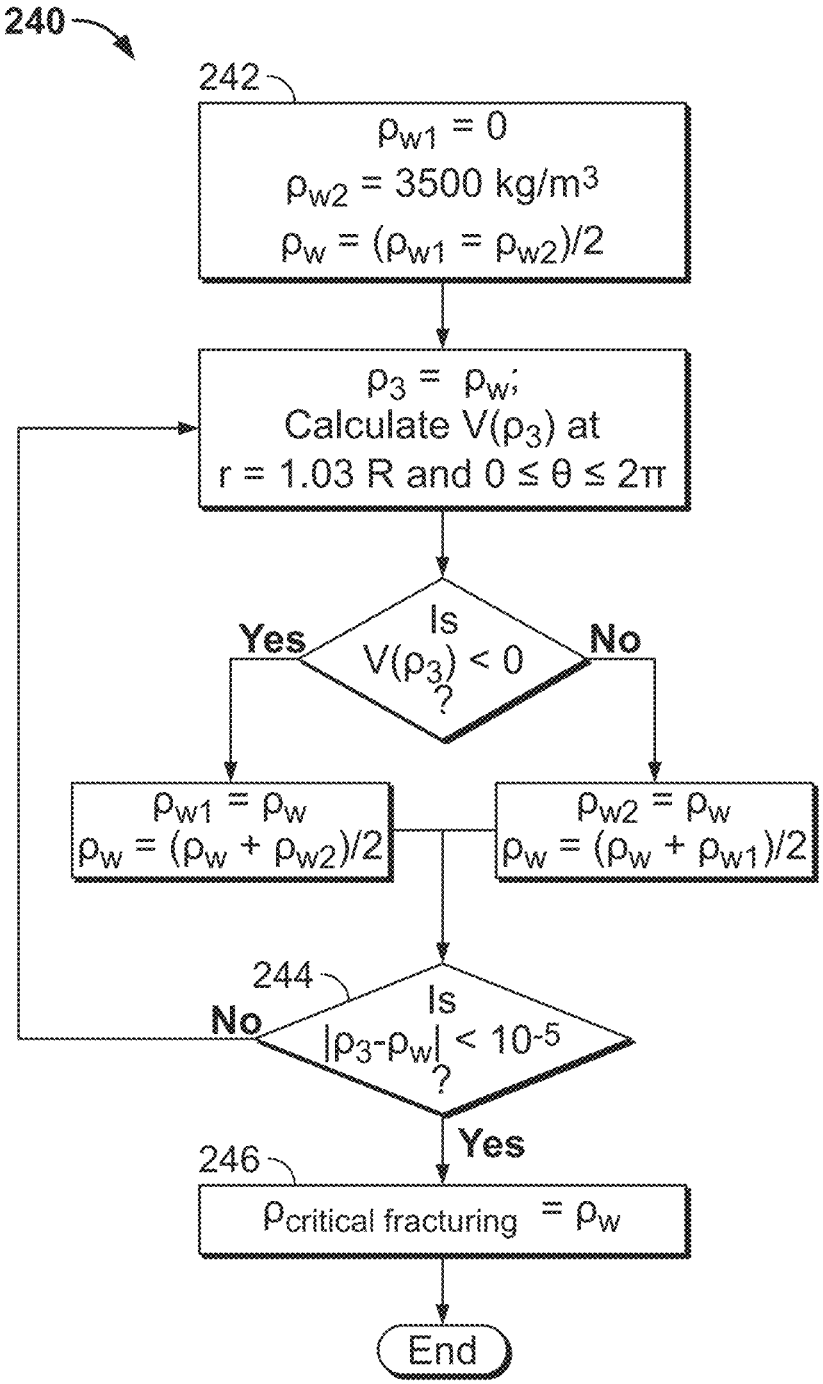
FIG. 11 is a flowchart of an algorithm to determine a critical fracturing mud weight.

FIG. 11 is a flowchart of an algorithm 240 to determine the relationship between the fracturing potential V and the mud weight. In some implementations, a computer (for example, computer 400) implements the algorithm 240 as part of model 1 to produce plot 230 shown in FIG. 10. In algorithm 240, $\rho_{w1}$ and $\rho_{w2}$ represent lower and upper bounds of the search range (which can be arbitrarily chosen), and $\rho_w$ represents the drilling mud pressure exerted on the wall of the wellbore. At block 242, algorithm 240 sets the initial $\rho_w$ as the average of $\rho_{w1}$ and $\rho_{w2}$ and then iteratively solves for $\rho_w$ until the condition of block 244 is satisfied. At block 246, algorithm 240 determines the critical fracturing mud weight $\rho_{critical\ fracturing}$ as the final value of $\rho_w$. If a drilling fluid having the critical fracturing mud weight is pumped into the wellbore, the formation is predicted to fracture. The maximum wellbore pressure p, in the wellbore is determined from the critical fracturing mud weight. In some implementations, the wellbore pressure is determined by solving:

$$p_w = 9.81 \times \rho_{critical\ fracturing} \times TVD \tag{24}$$

where TVD is the total vertical depth of the wellbore. The breakdown pressure is determined based on all of six stresses ($\sigma'_{rr}$, $\sigma'_{\theta\theta}$, $\sigma'_{zz}$, $\sigma'_{r\theta}$, $\sigma_{r\theta}$, and $\sigma_{rz}$). Generally, hoop stress ($\sigma'_{\theta\theta}$) has a dominant effect but all stresses affect the breakdown pressure.

Model 2: Time-Dependent Poroelastic Model with an Impermeable Constant-Thickness Filter Cake.

Model 2 uses time-dependent solutions of stresses and the algorithm 240 described above with reference to FIGS. 10 and 11 to calculate the time-dependent breakdown pressure. Model 2 is different from model 1 for the following reasons. First, model 2 accounts for a constant thickness of filter cake on the wellbore wall while model 1 does not account for filter cake at all. Model 2 accounts for the transient fluid flow through the formation (for example, via equation (5)) which is neglected in model 1.

Model 2 assumes that the permeability of the filter cake is much lower than the rock formation's permeability so the permeability of the filter cake is ignored in model 2. For example, filter cake permeability is sometimes in the range of 0.0001 mD to 0.001 mD which is much lower than the permeability of the rock formation which is usually larger than 0.01 mD. In some examples, the permeability of the filter cake is considered much lower than the rock formation's permeability when the permeability of the filter cake is at least 10 times less than the rock formation's permeability.

Figure 12:
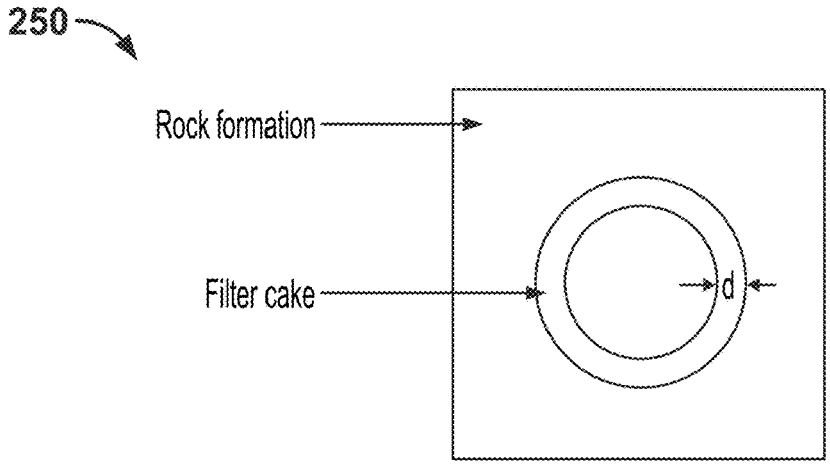
FIG. 12 is a plot of a constant thickness filter cake layer on a wellbore wall.

FIG. 12 is a plot 250 of a constant thickness d filter cake layer on a wellbore wall. Model 2 assumes that a constant-thickness filter cake is built up on the wellbore wall. The transient buildup of the filter cake is not considered in model 2 (but is considered in model 3). The systems and methods of this disclosure select model 2 when the layer of filter cake is constant and its thickness d does not change with time. In model 2, the filter cake has constant thickness d and is assumed to be impermeable.

Model 2 is implemented in the same manner as model 1 except that $d_m \neq 0$ in the boundary condition of equation (8) and the time dependence of the fluid mass balance equation (5) is solved rather than neglected. Another difference is that model 1 does not include filter cake while model 2 includes an impermeable and constant-thickness filter cake.

Model 3: Time-Dependent Poroelastic Model with Time-Dependent Thickness and Permeability Filter Cake.

Model 3 accounts for the time-dependent solutions of wellbore stresses and pore pressure, while accounting for the transient buildup of a filter cake. Model 3 considers a permeable wellbore wall. The effective stresses are calculated based on the following equations:

$$\sigma'_{rr} = \sigma_{rr} - p \tag{25}$$

$$\sigma'_{zz} = \sigma_{zz} - p \tag{26}$$

$$\sigma'_{\theta\theta} = \sigma_{\theta\theta} - p \tag{27}$$

where p is the formation pore pressure. This is in contrast to models 1 and 2 where the pressure of the drilling fluid pumped is used in equations (20-22) rather than the formation pore pressure as used in equations (25-27).

The permeability of the filter cake and the thickness of the filter cake are functions of position and time in model 3. This means that $k_m(\theta,t)$ and $d_m(\theta,t)$ in model 3. In some implementations, this time dependence is implemented as a look up table where the filter cake thickness and permeability which are modeled by equations (1-2) are interpolated based on the current solution time according to fluid mass balance equation (5).

Model 3 uses the time-dependent solutions of stresses and the algorithm 240 to calculate the time-dependent breakdown pressure. Model 3 considers the fluid flow in the rock formation while model 1 does not consider the fluid flow in the rock formation. Model 3 considers the time-dependent buildup of the filter cake while models 2 does not consider the time-dependent buildup of the filter cake. Model 3 assumes a finite, non-zero permeability of the filter cake while model 2 assumes zero-permeability of the filter cake. In some cases, model 3 is more representative than model 2 for the case of filter cake buildup in the field of a drilling operation.

The computer implements model 3 in the same manner as model 2. For model 2 and model 3, the computer solves equations (25-27) for the effective stresses. For model 1, the computer solves equations (20-22) for the effective stresses.

An Example of Breakdown Pressure Calculation for a Horizontal Wellbore

Referring to the wellbore environment 100 described with reference to FIGS. 1 and 2, this example considers pressure breakdown in the horizontal wellbore section 114 of the wellbore 110. This example illustrates the different breakdown pressures predictions from each of three models (models 1, 2, and 3) in addition to an impermeable model (where the formation is assumed to be impermeable). Using an impermeable model is a crude approximation of the breakdown pressure but is still used in practice.

The rock formation 108B and is assumed to be a tight sandstone. The properties of the rock formation 108B, wellbore orientation (of the horizontal wellbore section 114), and in-situ stresses and pore pressure are listed in Table 1.

TABLE 1

Wellbore orientation, in-situ stresses and pore pressure, and rock properties.

| | |
|---|---|
| TVD (ft) | 14,170 |
| Wellbore azimuth (degree) | 324 |
| Wellbore inclination (degree) | 90 |
| $S_H$ Azimuth (degree) | 85 |
| $dS_V$ (psi/ft) | 1.1 |
| $dS_H$ (psi/ft) | 1.12 |
| $dS_h$ (psi/ft) | 0.82 |
| dp (psi/ft) | 0.44 |
| E (psi) | $6.44 \times 10^6$ |
| v | 0.26 |
| k (mD) | 0.2 |
| μ (cP) | 2 |

In table 1, $S_H$ azimuth is the azimuth angle where the maximum horizontal in situ stress is directed, $dS_V$ is the gradient of vertical in-situ stress expressed in psi per foot of depth, $dS_H$ is the gradient of maximum horizontal in-situ stress expressed in psi per foot of depth, $dS_h$ is the gradient of minimum horizontal in-situ stress expressed in psi per foot of depth, dp (psi/ft) is the gradient of pore pressure expressed in psi per foot of depth, E is the Young's modulus of the rock formation, v is the Poission's ratio of the rock formation, k is the permeability of the rock formation, and μ is the viscosity of rock formation.

Figure 13:
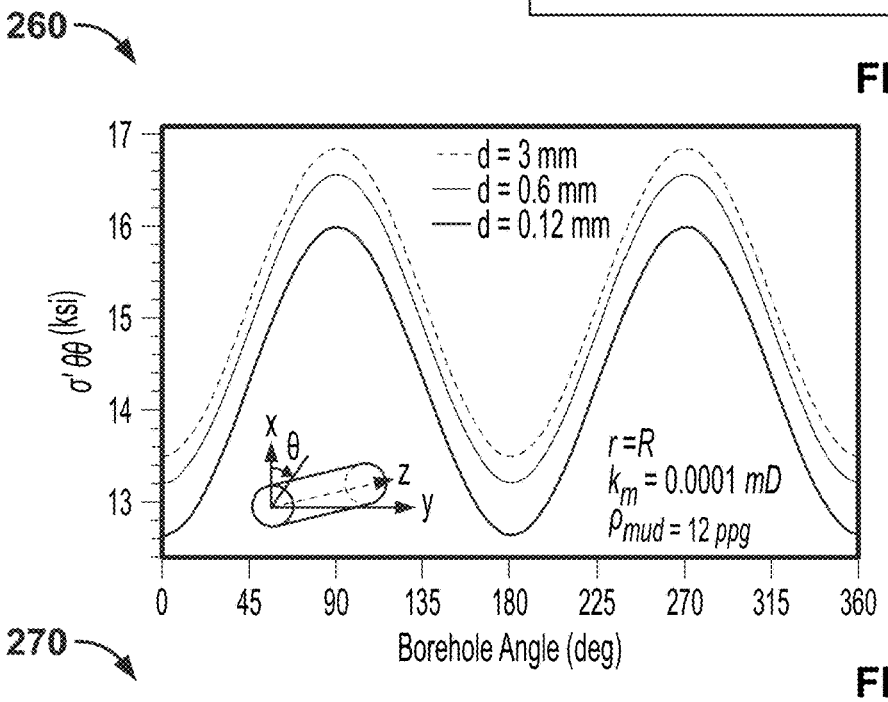
FIG. 13 is a plot of the effects of filter cake thickness on the effective tangential stress around the wellbore.
Figure 14:
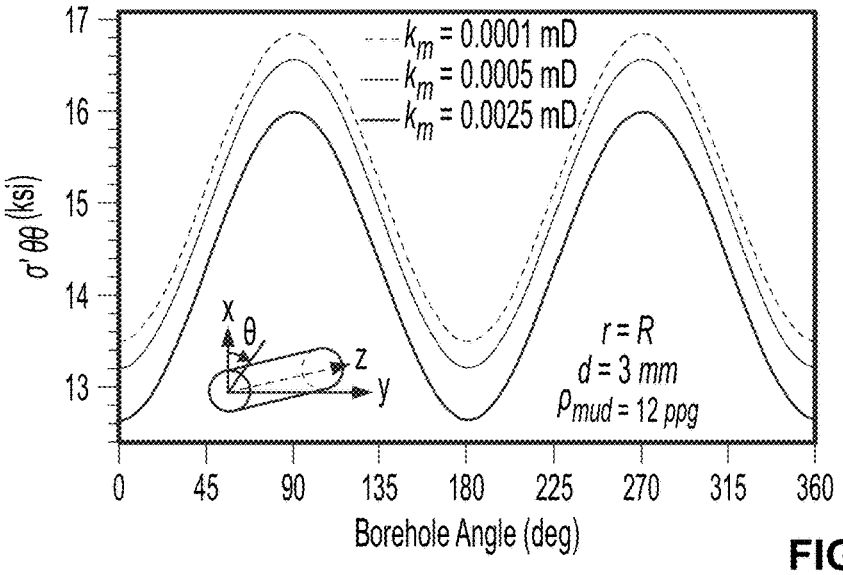
FIG. 14 is a plot of the effects of filter cake permeability on the effective tangential stress around the wellbore.

FIG. 13 is a plot 260 of the effects of filter cake thickness on the effective tangential stress around the wellbore and FIG. 14 is a plot 270 of the effects of filter cake permeability on the effective tangential stress around the wellbore. Thicker and less permeable filter cake results in higher effective tangential stress. This can be seen by taking an arbitrary section of the horizontal wellbore as an example in FIG. 14. Generally, hoop stress has a dominant effects on the breakdown pressure but all stress components affect the breakdown pressure. Hoop stress is chosen for plots 260 and 270 to show the effects of filter cake permeability on the variation of effective stresses.

Figure 15:
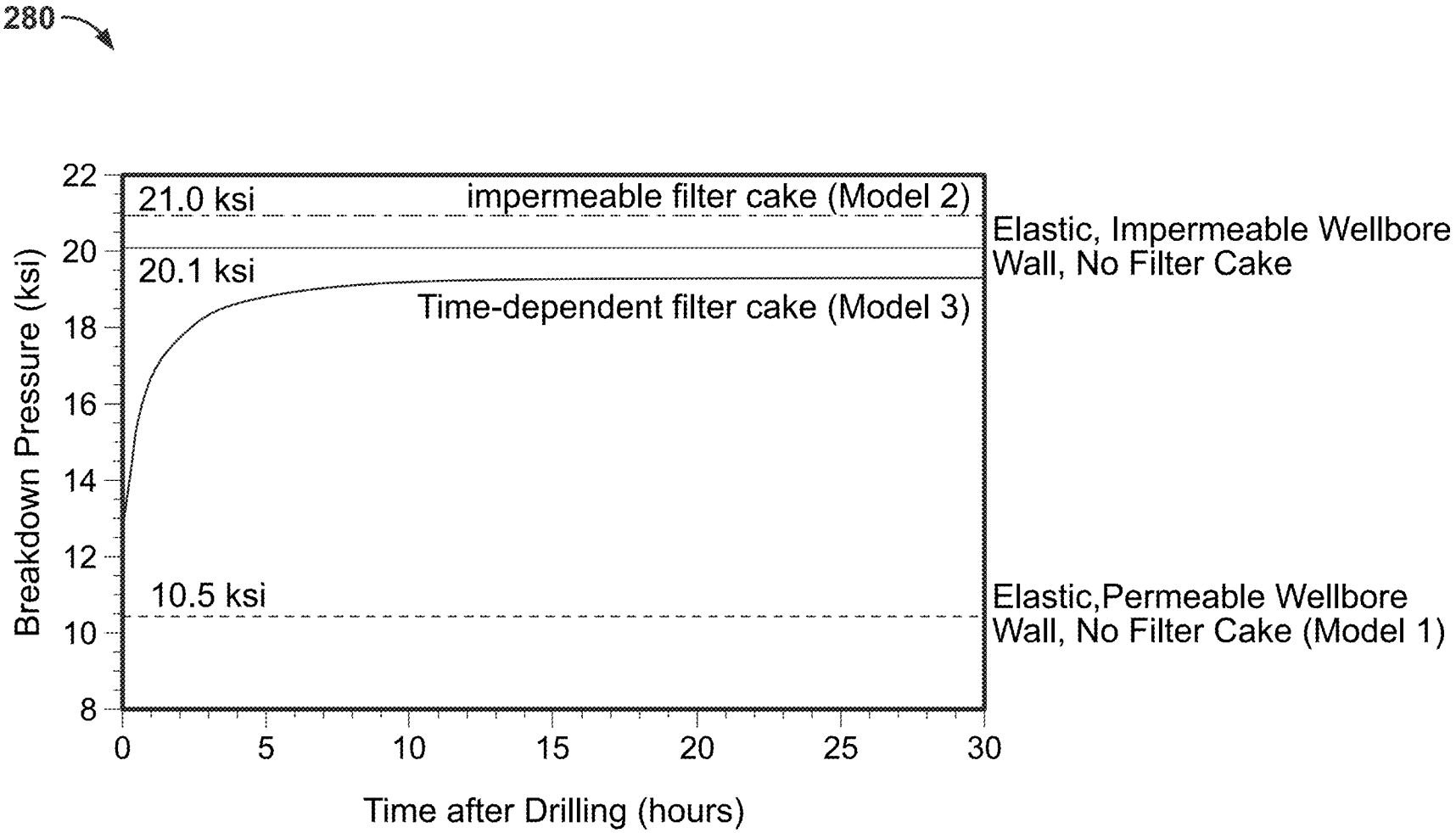
FIG. 15 is a plot of the breakdown pressure calculated by different models.

FIG. 15 is a plot 280 of the breakdown pressure calculated by models 1, 2, 3 and an impermeable model. The various models provide significantly different results. The impermeable model ("elastic, impermeable wellbore wall, no filter cake") results in a breakdown pressure of 20.1 ksi. Model 1 ("elastic, permeable wellbore wall, no filter cake") results in a breakdown pressure of 10.5 ksi. Model 2 ("impermeable filter cake") results in a breakdown pressure of 21.0 ksi. Model 3 ("time-dependent filter cake") results in a breakdown pressure that increases from about 13 ksi to about 19 ksi over the duration of about 10 hours. Models 1, 2, and the impermeable model predicts constant breakdown pressures due to the lack of time-dependent filter cake thickness and permeability effects.

Figure 16:
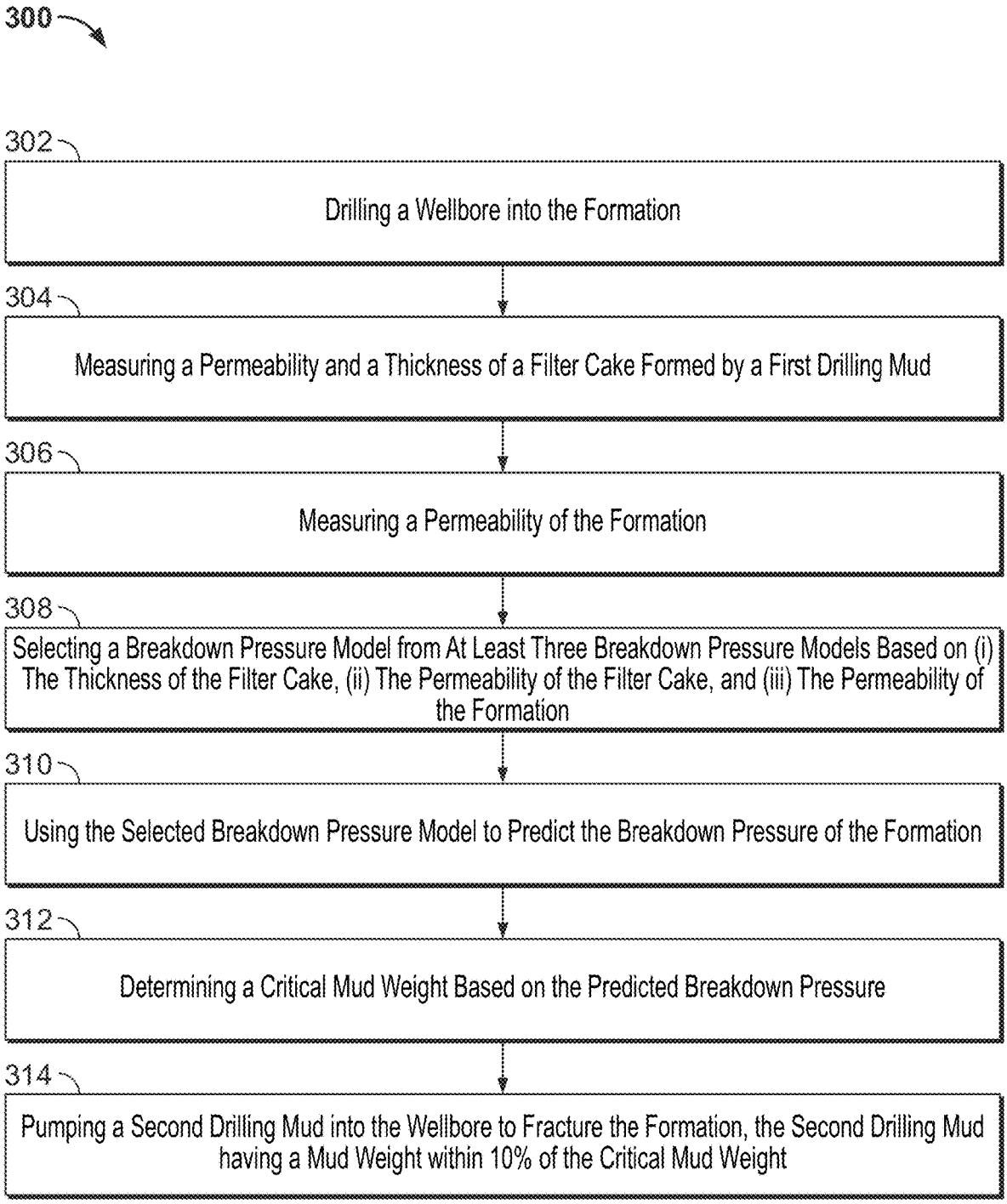
FIG. 16 is a flowchart of a method for determining breakdown pressure based on one or more properties of filter cake.

FIG. 16 is a flowchart of a method 300 for predicting breakdown pressure and fracturing a formation based on the predicted breakdown pressure. In some implementations, the processor 404 of the computer 400 described with reference to FIG. 19 executes computer code to perform one or more steps of the method 300. In some examples, a user (for example, an engineer) performs one or more steps of the method 300 manually or with the assistance of a logging device or a testing machine. In some implementations, logging devices, sensors, and testing machines perform one or more steps of the method 300.

At block 302, a wellbore is drilled into the formation. For example, the drill rig 102 of the wellbore environment 100 drills into the formation 108 using cutters 116 attached to an end of the drill string 106 to form the wellbore 110. In some examples, the wellbore 110 is drilled such that the wellbore 110 includes a vertical section 112 and a horizontal section 114.

In some implementations, a first drilling mud is pumped into the wellbore while the wellbore is being drilled. In some examples, the first drilling mud forms a layer of filter cake on one or more sections of the wellbore wall of the wellbore. For example, the pump 118 pumps drilling mud into the wellbore 110 which at least partially seeps into the formation 108 and causes a layer of filter cake 130 to form on the wellbore wall of the horizontal wellbore section 114.

At block 304, a permeability and a thickness of the filter cake are measured. In some implementations, the permeability and thickness of the filter cake are measured using a logging device. In some implementations, the permeability and thickness of the filter cake are measured using one or more sensors (for example, sensors 132 on the drill string 106). In some implementations, the logging device and/or the sensor are used to measure the permeability of the filter cake as a function of position and time and the thickness of the filter cake as a function of position and time. For example, the logging device and/or the sensors 132 traverse the wellbore 110 while it is drilled and/or after it is drilled to measure time and position dependence of the thickness and permeability of the filter cake.

In some implementations, the permeability and thickness of the filter cake are measured by testing a sample of the formation in a laboratory setting. For example, one or more samples are extracted from the formation and tested. In some examples, the sample is a core sample. In some examples, the sample is one or more drill cuttings.

In some implementations, a filtration experiment is performed on at least one of the samples to determine the permeability of the filter cake and the thickness of the filter cake. In some implementations, the filtration experiment follows the procedure described with reference to FIGS. 3-5. In some examples, the filtration experiment reveals whether a layer of the filter cake develops on a surface of the formation when the first drilling fluid is pumped through at least one of the samples. In some implementations, a position-and-time dependent thickness of the layer of filter cake is measured (e.g., using a sensor probe) when filtration experiment reveals that a layer of filter cake develops on the surface of the formation.

In some implementations, a time-dependent permeability model is fit to the filtration experiment data to represent the filter cake permeability as a function of time. In some examples, the time-dependent permeability model is a decaying exponential equation based on the filtration experiment data. In some examples, the time-dependent permeability model takes the form of equation (1) and the result shown in plot 180. In some examples, the time-dependent permeability model is a decaying exponential equation with an amplitude coefficient of 200 and a time constant of 16,666 which results in the expression of equation (1). In some examples, the time-dependent permeability model is curve fit to the filtration experiment data to determine a coefficient and a time constant of a decaying exponential equation.

In some implementations, a time-dependent thickness model is fit to the filtration experiment data to represent the filter cake thickness as a function of time. In some examples, the time-dependent thickness model is a decaying exponential equation based on the filtration experiment data. In some examples, the time-dependent permeability model takes the form of equation (2). In some examples, the time-dependent permeability model is a decaying exponential equation with an amplitude coefficient of 3 and a time constant of 10,000 which results in the expression of equation (2) and the result shown in plot 170. In some examples, the time-dependent thickness model is curve fit to the filtration experiment data to determine a coefficient and a time constant of a decaying exponential equation.

In some implementations, the time-dependent permeability model is a first exponential formula of $k_m=a_1\ (1+\exp(-t/tau_1))$ and the time-dependent thickness model is a second exponential formula of $d_m=a_2\ (1-\exp(-t/tau_2))$, where $a_1$, $tau_1$, $a_2$, and taut are determined based on the data from the filtration experiment. In some examples, $a_1=200$, $tau_1=16,666$, $a_2=3$, and $tau_2=10,000$.

In some implementations, the first drilling mud is pumped into the wellbore while the wellbore is being drilled to form the filter cake. A cleaning fluid is pumped into the wellbore after the wellbore is drilled to at least partially remove the filter cake from the wellbore. In some examples, the cleaning fluid comprises a chemical that removes the filter cake. In some implementations, the filtration experiment is used to determine one or more effects of the cleaning fluid on the filter cake. The time-dependent permeability model is updated based on the one or more effects of the cleaning fluid on the filter cake and the time-dependent thickness model is updated based on the one or more effects of the cleaning fluid on the filter cake.

At block 306, a permeability of the formation is measured. In some implementations, the permeability of the formation is measured using a logging device in the wellbore or in one or more offset wellbores. In some implementations, the permeability and thickness of the filter cake are measured by testing a sample of the formation in a laboratory setting. For example, a core flooding test or a field mini-frac test is performed on at least one of the samples to determine the permeability of the formation.

In some implementations, the rock type of the formation and other mechanical properties of the formation are measured and/or acquired. In some examples, the mechanical properties include the Elastic modulus of the rock, the Poisson's ratio of the rock, the viscosity of the rock, Biot's coefficient of the rock, Biot's modulus of the rock, the porosity of the rock, and whether the rock is naturally fractures. In some examples, the rock type represents whether the rock is shale, sandstone, limestone, cap rock, or another rock type. These mechanical properties are used in the breakdown pressure models.

In some implementations, the computer 400 receives the time-dependent thickness model and the time-dependent permeability model and uses the time-dependent thickness model and the time-dependent permeability model to determine the permeability and thickness of the filter cake. In some implementations, the computer 400 receives the logging data and/or data from the sensors 132 and determines the permeability and thickness of the filter cake. In some implementations, a user manually inputs the permeability and thickness of the filter cake into the computer 400 using a user interface.

At block 308, a breakdown pressure model is selected from at least three breakdon pressure models based on (i) the thickness of the filter cake, (ii) the permeability of the filter cake, and (iii) the permeability of the formation. In some implementations, the computer 400 automatically executes computer code to select the breakdown pressure without user intervention or assistance. In some implementations, the selected breakdown pressure model predict the breakdown pressure of the formation by accounting for position and time variations of the thickness of the layer of the filter cake. In some implementations, the breakdown pressure model is selected based on the position-and-time-dependent thickness of the filter cake and the permeability of the formation. In some implementations, at least one of the at least three breakdown pressure models accounts for a time-dependent permeability of the filter cake and a time-dependent thickness of the filter cake (for example, model 3).

In some implementations, the computer 400 selects among (i) a first model (for example, model 1) that neglects filter cake effects and neglects time-dependency, (ii) a second model (for example, model 2) that includes filter cake effects and neglects time-dependency, and (iii) a third model (for example, model 3) that includes filter cake effects and includes time-dependency. Each of these three models are described in this disclosure.

In some implementations, the method 300 determines whether the position-and-time dependent thickness of the filter cake is greater than zero and determines whether the permeability of the formation is greater than a predetermined permeability between 1 μD and 100 μD. In these cases, the breakdown pressure model is selected based on whether the position-and-time dependent thickness of the filter cake is greater than zero and whether the permeability of the formation is greater than the predetermined permeability. In some implementations, the breakdown pressure model is selected based on the position-and-time-dependent-permeability of the filter cake and the position-and-time-dependent thickness of the filter cake.

In some implementations, the computer 400 determines whether the thickness of the filter cake is greater than zero and determines whether the permeability of the formation is greater than a predetermined permeability. In some implementations, the predetermined permeability is a permeability between 1 μD and 100 μD. In such cases, the breakdown pressure model is selected based on whether the thickness of the filter cake is greater than zero and whether the permeability of the formation is greater than the predetermined permeability. For example, responsive to determining that the thickness of the filter cake is not greater than zero and that the permeability of the formation is greater than the predetermined permeability, the computer 400 selects the first model (for example, model 1) that neglects filter cake effects and neglects time-dependency.

In some implementations, a permeability ratio of the permeability of the filter cake and the permeability of the formation is determined. In some implementations, the computer 400 determines whether the permeability ratio is below a predetermined ratio. In some implementations, the predetermined ratio is a ratio between 1% and 10%. In some implementations, the computer 400 determines whether the thickness of the filter cake is approximately constant with respect to time. In these cases, responsive to determining that the permeability ratio is below the predetermined ratio and that the thickness of the filter cake is approximately constant with respect to time, the computer 400 selects the second model (for example, model 2) that includes filter cake effects and neglects time-dependency.

In some implementations, responsive to determining that the thickness of the filter cake is not approximately constant with respect to time, the computer 400 selects the third model (for example, model 3) that includes filter cake effects and includes time-dependency. In some examples, the third model accounts for changes in the thickness of the filter cake as a function of position on the formation and the second model neglects changes in the thickness of the filter cake as a function of position on the formation.

At block 310, the selected breakdown pressure model is used to predict the breakdown pressure of the formation. For example, the computer 400 executes the algorithm 240 described with reference to FIGS. 10 and 11 to predict the breakdown pressure based on the selected breakdown pressure model. In some implementations, when the third model is selected, the third model interpolates the time-dependent thickness model and the time-dependent permeability model of the filter cake to determine the breakdown pressure.

In some implementations, in-situ stresses and pore pressure of the formation are determined from logging data and used in the breakdown pressure models. For example, each of model 1, model 2, and model 3 use in-situ stresses and pore pressure of the formation to determine the breakdown pressure.

In some implementations, a tensile test is performed on at least one of the samples of the formation to determine a tensile strength of the formation. In some implementations, the tensile strength is used by the computer 400 to predict the breakdown pressure as described with reference to FIG. 10.

At block 312, a critical mud weight is determined based on the predicted breakdown pressure. For example, the computer 400 executes the algorithm 240 described with reference to FIGS. 10 and 11 to determine the critical mud weight $\rho_{critical\ fracturing}$.

At block 314, a second drilling mud is pumped into the wellbore to fracture the formation. For example, the second drilling mud causes one or more fractures 152 to form as described with reference to FIG. 2. The second drilling mud has a mud weight within a predetermined range of the critical mud weight. In some examples, the predetermined range is 10%. In some examples, the predetermined range is 2%. In some examples, the predetermine range is between 1% and 20%.

In some implementations, the wellbore is completed (for example, by installing a production casing and replacing the drilling rig 102 with production equipment) and used to extract one or more hydrocarbons (for example, oil and gas) from the wellbore.

Figure 17:
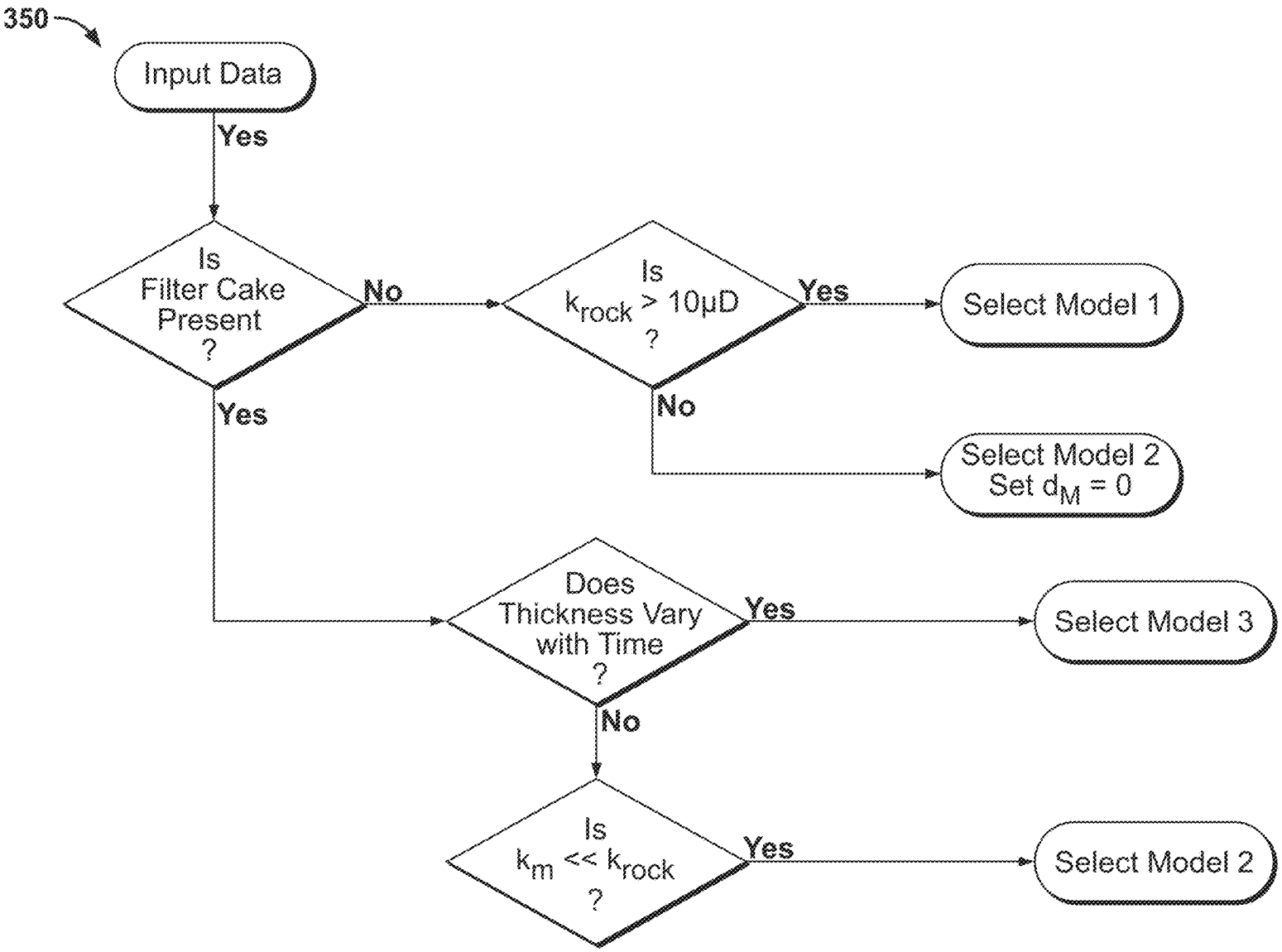
FIG. 17 is a flowchart of a method for selecting a breakdown pressure model.

FIG. 17 is a flowchart of a method 350 for selecting the breakdown pressure model. In some implementations, the block 308 of method 300 includes the steps of method 350. In some examples, if the formation permeability is high (for example, between 0.01-100 mD) and there is no significant filter cake present, the method 350 selects model 1. In some implementations, if the formation permeability is low (for example, between 1-1000 nD) and there is no significant filter cake, the method 350 selects model 2 with thickness $d_m$ set to zero. If the buildup of filter cake becomes stable and has a constant thickness with relatively far lower permeability than the formation's permeability (for example, less than 1% or less than 10%), the method 350 selects model 2. If the thickness of the filter cake changes with time, the method 350 selects model 3.

Figure 18:
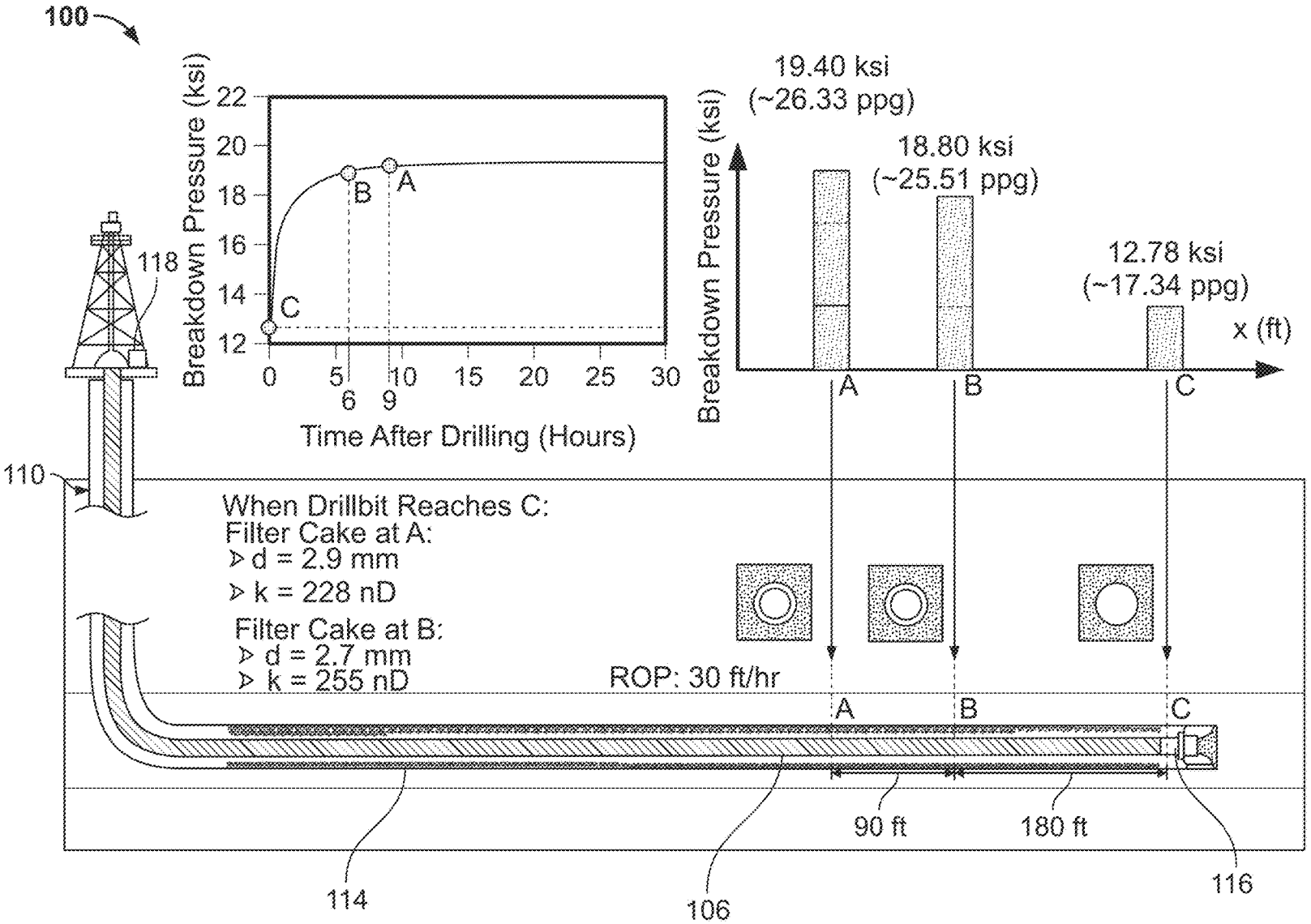
FIG. 18 is an illustration of the variation of breakdown pressure along the horizontal wellbore of FIG. 1.

FIG. 18 is an illustration of the wellbore environment 100 with different breakdown pressure predictions along the length of the horizontal wellbore section 114. Different breakdown pressures are predicted because the thickness of filter cake varies along the horizontal wellbore section 114. For example, the pump 118 pumps drilling mud into the wellbore 110 at a rate of penetration of 30 ft/hour. As the drilling operation continues, filter cake starts to build up and accumulate which affects the breakdown pressures.

The systems and methods described in this disclosure predict breakdown pressures at one or more locations along the wellbore 110. The systems and methods allow a user to access the data and plot the data at intervals along the wellbore 110 for data processing and visualization. In this example, the user requests that breakdown pressures be plotted at locations A, B, and C along the horizontal wellbore section 114. Location C is approximately at the end of drill string 106 where the cutters 116 are coupled to the drill string 106. No filter cake is built up at location C. The predicted breakdown pressure at location C was solved using model 1 since no filter cake is present. Model 1 predicted a breakdown pressure of 12.78 ksi which can be reached by using a mud weight of 17.34 ppg. Pumping a drilling fluid with 17.34 ppg into the wellbore will cause fractures to form at location C.

Location B is approximately 180 feet from the end of drill string 106. A constant layer of filter cake is built up at location B. The predicted breakdown pressure at location B was solved using model 2 since a constant layer of filter cake is present. Model 2 predicted a breakdown pressure of 18.80 ksi which can be reached by using a mud weight of 25.51 ppg. Pumping a drilling fluid with 25.51 ppg into the wellbore will cause fractures to form at location B and also at location C since the required breakdown pressure is lower at location C than location B.

Location A is approximately 270 feet from the end of drill string 106. A constant layer of filter cake is built up at location A with a thickness greater than the thickness at location B. The predicted breakdown pressure at location C was solved using model 2 since a constant layer of filter cake is present. Model 2 predicted a breakdown pressure of 19.40 ksi which can be reached by using a mud weight of 26.33 ppg. Pumping a drilling fluid with 26.33 ppg into the wellbore will cause fractures to form at location A, B, and C.

Figure 19:
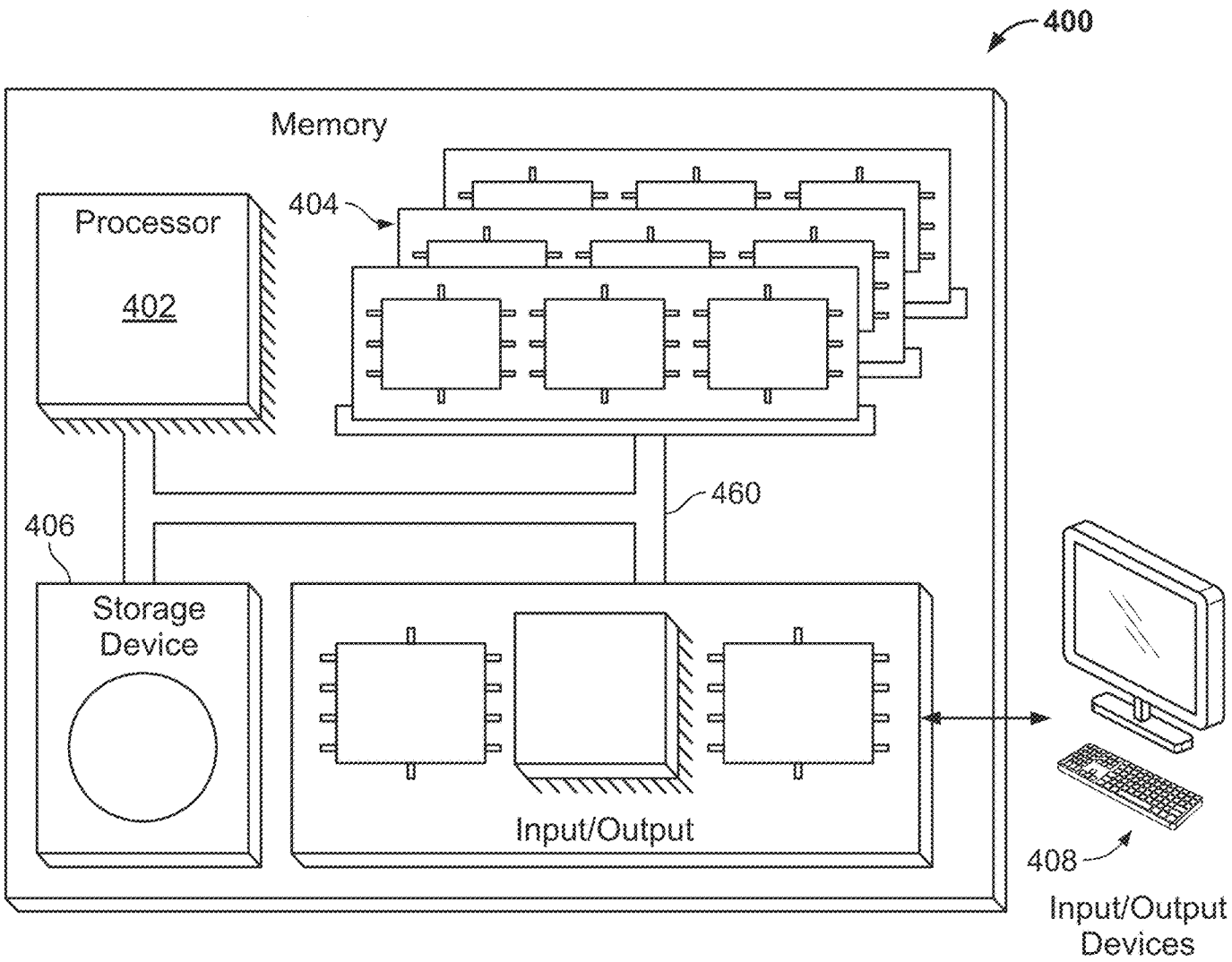
FIG. 19 is a schematic of a computer for executing one or more steps of the systems and methods described throughout this disclosure.

FIG. 19 is a schematic of a computer 400 for executing one or more steps of the systems and methods described throughout this disclosure. For example, the computer 400 is used to determine the breakdown pressures for model 1, model 2, and model 3 and perform one or more steps of the methods described in this disclosure.

The computer 400 is intended to include various forms of digital computers, such as printed circuit boards (PCB), processors, digital circuitry, or otherwise parts of a system for determining a subterranean formation breakdown pressure. Additionally the system can include portable storage media, such as, Universal Serial Bus (USB) flash drives. For example, the USB flash drives may store operating systems and other applications. The USB flash drives can include input/output components, such as a wireless transmitter or USB connector that may be inserted into a USB port of another computing device.

The computer 400 includes a processor 402, a memory 404, a storage device 406, and an input/output device 408 (for example, displays, input devices, sensors, valves, pumps, etc.). Each of the components 402, 404, 406, and 408 are interconnected using a system bus 460. The processor 402 is capable of processing instructions for execution within the computer 400. The processor may be designed using any of a number of architectures. For example, the processor 402 may be a CISC (Complex Instruction Set Computers) processor, a RISC (Reduced Instruction Set Computer) processor, or a MISC (Minimal Instruction Set Computer) processor.

In one implementation, the processor 402 is a single-threaded processor. In another implementation, the processor 402 is a multi-threaded processor. The processor 402 is capable of processing instructions stored in the memory 404 or on the storage device 406 to display graphical information for a user interface on the input/output device 408.

The memory 404 stores information within the computer 400. In one implementation, the memory 404 is a computer-readable medium. In one implementation, the memory 404 is a volatile memory unit. In another implementation, the memory 404 is a non-volatile memory unit.

The storage device 406 is capable of providing mass storage for the computer 400. In one implementation, the storage device 406 is a computer-readable medium. In various different implementations, the storage device 406 may be a floppy disk device, a hard disk device, an optical disk device, or a tape device.

The input/output device 408 provides input/output operations for the computer 400. In one implementation, the input/output device 408 includes a keyboard and/or pointing device. In another implementation, the input/output device 408 includes a display unit for displaying graphical user interfaces.

The features described can be implemented in digital electronic circuitry, or in computer hardware, firmware, software, or in combinations of them. The apparatus can be implemented in a computer program product tangibly embodied in an information carrier, for example, in a machine-readable storage device for execution by a programmable processor; and method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) monitor for displaying information to the user and a keyboard and a pointing device such as a mouse or a trackball by which the user can provide input to the computer. Additionally, such activities can be implemented via touch-screen flat-panel displays and other appropriate mechanisms.

The features can be implemented in a control system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include a local area network ("LAN"), a wide area network ("WAN"), peer-to-peer networks (having ad-hoc or static members), grid computing infrastructures, and the Internet.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous.

Moreover, the separation of various system components in the implementations described above should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A method for fracturing a formation, the method comprising:

drilling a wellbore into the formation;

measuring a time-dependent permeability and a time-dependent thickness of a filter cake formed by a first drilling mud;

determining a time-dependent permeability model based on the measured time-dependent permeability of the filter cake;

determining a time-dependent thickness model of the filter cake based on the measured time-dependent thickness of the filter cake;

measuring a permeability of the formation;

selecting a breakdown pressure model based on (i) the time-dependent thickness of the filter cake, (ii) the time-dependent permeability of the filter cake, and (iii) the permeability of the formation;

using the selected breakdown pressure model to predict the breakdown pressure of the formation, wherein using the selected breakdown pressure model comprises using the time-dependent thickness model of the filter cake and the time-dependent permeability model of the filter cake in the breakdown pressure model;

determining a critical mud weight based on the predicted breakdown pressure; and pumping a second drilling mud into the wellbore to fracture the formation, the second drilling mud having a mud weight within 10% of the critical mud weight.

2. The method of claim 1, further comprising:

extracting one or more samples from the formation; and performing a filtration experiment on at least one of the one or more samples by pumping the first drilling mud through the at least one sample to measure the time-dependent permeability of the filter cake and the time-dependent thickness of the filter cake.

3. The method of claim 2, wherein determining the time-dependent permeability model of the filter cake comprises determining one or more parameters to a first exponential formula based on data from the filtration experiment, and determining the time-dependent thickness model of the filter cake comprises determining one or more parameters to a second exponential formula based on the data from the filtration experiment.

4. The method of claim 3, wherein the first exponential formula is $k_m=a_1\ (1+\exp(-t/tau_1))$ and the second exponential formula is $d_m=a_2\ (1-\exp(-t/tau_2))$, where $a_1$, $tau_1$, $a_2$, and taut are determined based on the data from the filtration experiment.

5. The method of claim 2, further comprising:

performing a core flooding test or a field mini-frac test on at least one of the one or more samples to determine the permeability of the formation;

performing a tensile test on at least one of the one or more samples to determine a tensile strength of the formation; and using the tensile strength to predict the breakdown pressure.

6. The method of claim 2, further comprising:

pumping the first drilling mud into the wellbore while the wellbore is being drilled to form the filter cake;

pumping a cleaning fluid into the wellbore after the wellbore is drilled to at least partially remove the filter cake from the wellbore;

using the filtration experiment to determine one or more effects of the cleaning fluid on the filter cake;

updating the time-dependent permeability model based on the one or more effects of the cleaning fluid on the filter cake; and updating the time-dependent thickness model based on the one or more effects of the cleaning fluid on the filter cake.

7. The method of claim 1, further comprising:

pumping the first drilling mud into the wellbore while the wellbore is being drilled to form the filter cake;

completing the wellbore; and extracting one or more hydrocarbons from the wellbore after the wellbore has been completed.

8. The method of claim 7, wherein the filter cake is located on a wall of the wellbore and the method further comprises using at least one of a logging device or a sensor to measure the permeability and the thickness of the filter cake within the wellbore.

9. The method of claim 1, wherein selecting the breakdown pressure comprises automatically selecting the breakdown pressure by a processor.

10. A method for fracturing a formation, the method comprising:

drilling a wellbore into the formation;

measuring a permeability and a thickness of a filter cake formed by a first drilling mud;

measuring a permeability of the formation;

selecting a breakdown pressure model from at least three breakdown pressure models based on (i) the thickness of the filter cake, (ii) the permeability of the filter cake, and (iii) the permeability of the formation, wherein at least one of the at least three breakdown pressure models accounts for a time-dependent permeability of the filter cake and a time-dependent thickness of the filter cake;

using the selected breakdown pressure model to predict the breakdown pressure of the formation;

determining a critical mud weight based on the predicted breakdown pressure; and pumping a second drilling mud into the wellbore to fracture the formation, the second drilling mud having a mud weight within 10% of the critical mud weight.

11. The method of claim 10, further comprising:

determining whether the thickness of the filter cake is greater than zero; and determining whether the permeability of the formation is greater than a predetermined permeability, wherein the breakdown pressure model is selected based on whether the thickness of the filter cake is greater than zero and whether the permeability of the formation is greater than the predetermined permeability.

12. The method of claim 11, wherein the predetermined permeability is a permeability between 1 μD and 100 μD.

13. The method of claim 11, wherein selecting the breakdown pressure model comprises responsive to determining that the thickness of the filter cake is not greater than zero and that the permeability of the formation is greater than the predetermined permeability, selecting a first breakdown pressure model of the at least three breakdown pressure models that neglects filter cake effects and neglects time-dependency.

14. The method of claim 10, further comprising:

determining a permeability ratio of the permeability of the filter cake and the permeability of the formation;

determining whether the permeability ratio is below a predetermined ratio;

determining whether the thickness of the filter cake is approximately constant with respect to time; and responsive to determining that the permeability ratio is below the predetermined ratio and that the thickness of the filter cake is approximately constant with respect to time, selecting a second breakdown pressure model of the at least three pressure breakdown models that includes filter cake effects and neglects time-dependency.

15. The method of claim 14, wherein the predetermined ratio is a ratio between 1% and 10%.

16. The method of claim 14, wherein selecting the breakdown pressure model comprises responsive to determining that the thickness of the filter cake is not approximately constant with respect to time, selecting a third breakdown pressure model of the at least three breakdown pressure models that includes filter cake effects and includes time-dependency.

17. The method of claim 16, wherein the third breakdown pressure model accounts for changes in the thickness of the filter cake as a function of position and the second model neglects changes in the thickness of the filter cake as a function of position.

18. The method of claim 10, wherein selecting the breakdown pressure comprises automatically selecting the breakdown pressure by a processor.

19. The method of claim 10, further comprising:

extracting one or more samples from the formation;

performing a filtration experiment on at least one of the one or more samples by pumping the first drilling mud through the at least one sample to measure the permeability of the filter cake and the thickness of the filter cake;

determining a time-dependent thickness model of the filter cake based on data from the filtration experiment;

determining a time-dependent permeability model of the filter cake based on data from the filtration experiment;

wherein the at least one breakdown pressure model that accounts for the time-dependent permeability of the filter cake and the time-dependent thickness of the filter cake uses the time-dependent thickness model and the time-dependent permeability model to predict the breakdown pressure.

20. The method of claim 19, wherein the time-dependent permeability model is a first exponential formula of $k_m=a_1(1+\exp(-t/tau_1))$ and the time-dependent thickness model is a second exponential formula of $d_m=a_2(1-\exp(-t/tau_2))$, where $a_1$, $tau_1$, $a_2$, and $tau_2$ are determined based on the data from the filtration experiment.

* * * * *